US010018144B2

(12) United States Patent
Ranga et al.

(10) Patent No.: US 10,018,144 B2
(45) **Date of Patent: *Jul. 10, 2018**

(54) METHODS AND SYSTEM FOR ENGINE CONTROL

(71) Applicant: Ford Global Technologies, LLC, Dearborn, MI (US)

(72) Inventors: Adithya Pravarun Re Ranga, Canton, MI (US); Gopichandra Surnilla, West Bloomfield, MI (US); Joseph Lyle Thomas, Kimball, MI (US); Ethan D. Sanborn, Saline, MI (US); Mark Thomas Linenberg, Howell, MI (US); Kenneth John Behr, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/242,188

(22) Filed: Aug. 19, 2016

(65) Prior Publication Data

US 2018/0051647 A1 Feb. 22, 2018

(51) Int. Cl.

| | |
|---|---|
| ***F02D 41/40*** | (2006.01) |
| ***F02D 41/14*** | (2006.01) |
| ***F02D 41/26*** | (2006.01) |
| ***F02D 35/00*** | (2006.01) |
| *F02D 41/38* | (2006.01) |

(52) U.S. Cl.

CPC ..... *F02D 41/402* (2013.01); *F02D 35/0092* (2013.01); *F02D 41/1454* (2013.01); *F02D 41/26* (2013.01); *F02D 2041/389* (2013.01)

(58) Field of Classification Search

CPC .. F02D 41/402; F02D 41/1454; F02D 41/263; F02D 2041/389; F02D 2200/08

USPC ..... 701/103, 104, 114; 123/295–299; 73/114.41, 114.51, 114.66, 114.72, 73/114.77

See application file for complete search history.

(56) References Cited

U.S. PATENT DOCUMENTS

| | | | | |
|---|---|---|---|---|
| 5,491,631 | A * | 2/1996 | Shirane | F02D 41/22 123/479 |
| 6,138,638 | A * | 10/2000 | Morikawa | F02D 41/061 123/295 |
| 6,138,655 | A * | 10/2000 | Kerns | F02D 41/0042 123/674 |
| 2003/0221659 | A1 * | 12/2003 | Surnilla | F01N 3/0814 123/295 |

(Continued)

OTHER PUBLICATIONS

Ranga, Adithya Pravarun Re, et al., "Method and System for Engine Control," U.S. Appl. No. 15/242,050, filed Aug. 19, 2016, 76 pages.

*Primary Examiner* — John Kwon
*Assistant Examiner* — Johnny H Hoang
(74) *Attorney, Agent, or Firm* — Julia Voutyras; McCoy Russell LLP

(57) ABSTRACT

Systems and methods for determining air-fuel error in an engine fueled via direct and port fuel injection. Errors associated with individual fuel injection systems are distinguished from a common error based on trends in the error correction coefficients of the individual fuel injection systems. Adaptive fuel multipliers for each injection system are updated to account for the common error.

17 Claims, 7 Drawing Sheets

(56) References Cited

U.S. PATENT DOCUMENTS

| | | | | |
|---|---|---|---|---|
| 2006/0207558 | A1* | 9/2006 | Tahara | F02D 41/221<br>123/431 |
| 2009/0088948 | A1* | 4/2009 | Nakagawa | F02D 41/0002<br>701/103 |
| 2009/0260428 | A1* | 10/2009 | Yamashita | F02D 41/18<br>73/114.31 |
| 2010/0132681 | A1* | 6/2010 | Okazaki | F02D 41/1441<br>123/703 |
| 2012/0006307 | A1* | 1/2012 | Demura | F02D 41/1454<br>123/674 |
| 2012/0065870 | A1* | 3/2012 | Okazaki | F02D 41/1441<br>701/104 |
| 2012/0297866 | A1* | 11/2012 | Tanaka | G01M 15/104<br>73/114.31 |
| 2013/0151118 | A1* | 6/2013 | Yamazaki | F02D 43/04<br>701/103 |
| 2013/0184973 | A1* | 7/2013 | Okazaki | F02D 41/30<br>701/104 |
| 2016/0131072 | A1 | 5/2016 | Surnilla et al. | |

* cited by examiner

200

| ENGINE LOAD | 500 | 1000 | 2000 | 3000 | 4000 | 5000 |
|---|---|---|---|---|---|---|
| 0.9 | 1 | 0.98 | 1 | 1.01 | 1.02 | 1.25 |
| 0.8 | 1 | 1 | 0.98 | 0.99 | 1.15 | 1.20 |
| 0.7 | 1.01 | 1 | 0.96 | 1.03 | 1.04 | 1.15 |
| 0.6 | 0.85 | 0.90 | 0.97 | 0.99 | 0.98 | 1.10 |
| 0.5 | 0.80 | 0.92 | 0.96 | 1.01 | 1.02 | 0.98 |
| 0.4 | 0.90 | 0.95 | 0.98 | 1.02 | 1 | 0.97 |
| 0.3 | 0.75 | 0.98 | 0.99 | 1 | 1.01 | 0.98 |
| 0.2 | 0.96 | 0.99 | 1.01 | 1 | 1.02 | 0.99 |
| 0.1 | 0.97 | 0.96 | 1 | 1.05 | 1.08 | 1.10 |
| 0 | 0.98 | 0.99 | 1 | 1.05 | 1.06 | 1.05 |

ENGINE SPEED

600

Engine speed
602
Engine load
604
DI fraction
1
0
606
PFI fraction
1
0
608
Air-fuel ratio/ lambda
610
612
Adapted fuel multiplier
614
616
Kamrf$_{DI}$
618
620
622
624
Kamrf$_{PFI}$
626
628
630
632
Kamrf$_{CE}$
634
636
638
640
DI Injector transfer function
1
0
642
PFI Injector transfer function
1
0
644
T0
T1
T2
T3
T4
T5
Time

METHODS AND SYSTEM FOR ENGINE CONTROL

FIELD

The present description relates to systems and methods for determining fuel injector error in an internal combustion engine.

BACKGROUND/SUMMARY

Dual fueling engine systems with direct and port fuel injectors may be configured to operate under a wide range of engine operating conditions. For example, at higher engine speeds and loads, fuel may be directly injected into engine cylinders to increase engine torque and enhance cooling of cylinder charge mixtures while minimizing chances of engine knock. At lower engine speeds and loads, fuel may be injected via port fuel injection to reduce particulate matter emissions. Specifically, port injected fuel may quickly evaporate as fuel is drawn into an engine cylinder, reducing particulate matter buildup while improving fuel efficiency. Fuel may be injected into an engine via both direct and port fuel injection during mid-speeds and loads in order to improve combustion stability and reduce engine emissions. Therefore, an engine with direct injectors (DI) and port fuel injectors (PFI) can leverage the advantages of each individual injection type.

While it may be beneficial to incorporate port and direct fuel injectors into an engine, supplying fuel via two different injection systems may make it difficult to distinguish injection errors resulting from the port injector from those resulting from the direct injector. One example approach for determining which fuel injection source is introducing fueling errors into the engine is shown by Surnilla et al in US20160131072. Therein, port and direct fuel injector errors are determined by calculating a ratio of a change in fuel multiplier values and a change in fraction of fuel injected into engine via port and direct injection, wherein fuel multiplier values are determined based on a measured air-fuel ratio. A port injector error is determined by calculating a ratio of a change in fuel multiplier values and a change in fraction of port injected fuel, and a direct injector error is determined by calculating a ratio of change in fuel multiplier values and a change in fraction of directly injected fuel.

However the inventors herein have identified potential issues with such a system. As one example, the approach is not able to distinguish fueling errors of direct and port fuel injectors from a common error. As such, an air-fuel ratio error in an engine may have an error contribution from one or more of the direct injector, the port injector, and the common error. The common error may include a common fuel type error and/or an air error. A common fuel type error may occur when a quality of a fuel being injected into the engine degrades. For example, changes in fuel viscosity may cause both port and direct fuel injectors to provide a lower or a larger fuel amount than expected, causing a common fuel type error. Alternatively, a common fuel type error may occur when the actual fuel injected into engine is different from the expected fuel, such as when the oxygen content of a fuel injected into a flex fuel engine deviates from the oxygen content of the fuel refilled into the fuel tank. Further still, the common error may be an air error caused by a degraded engine sensor such as mass air flow sensor, a pressure sensor or a throttle position sensor. Alternatively, an air error in a multi-cylinder engine may occur if some engine cylinders receive more air than other cylinders due to location of the cylinders along an intake air passage or due to a configuration of the intake passage.

Discrepancies in learning air-fuel error in an engine fueled via both direct and port fuel injection may occur when direct and port fuel injector errors are determined without accounting for the common error. For example, a common error in an engine may be misdiagnosed as both a direct and port fuel injector error, with the adaptive fuel multiplier (or transfer functions) for both injectors being affected. As such, this can result in overcompensation for the error. For example, an engine controller may identify the error as a direct injector error or a port injector error and may correct for the error by adjusting a transfer function of the corresponding injector, and disabling the degraded injector. However, if the air-fuel error is due, at least in part, to a common error, the air-fuel error may persist even after the transfer function of a fuel injector is adjusted. In addition, the common error may cause a fuel injector to appear degraded. The controller may disable the fuel injector responsive to the incorrect indication of degradation, as a result of which the advantages of that particular injection type may not be leveraged.

In one example, the issues described above may be addressed by a method comprising: fueling a cylinder via a first and a second fuel injector; estimating each of a first injection error of the first injector, a second injection error of the second injector, and a common error as a function of an air-fuel ratio error and a fraction of fuel injected via each of the first and second injector; and correcting each of the first and second error based on the common error. By separating individual error contributions of each of a direct fuel injector and a port fuel injector from the common error, air-fuel errors may be better compensated for. Overall, engine performance and exhaust emissions are improved.

For example, a total air-fuel error may be determined in an engine fueled with both direct and port fuel injectors as a difference between an actual air-fuel ratio (determined at an exhaust gas sensor) and an expected air-fuel ratio. A portion of that error that is due to a fueling error of the direct fuel injector may be determined as a function of the rate of change in the air-fuel ratio error relative to a rate of change in the fraction of the total fuel injected via direct injection. Likewise, a portion of that error that is due to a fueling error of the port fuel injector may be determined as a function of a rate of change in the air-fuel ratio error relative to a rate of change in the fraction of the total fuel injected via port injection. If the ratios for both the port and direct injectors change by a small magnitude during engine operation but the air-fuel errors corresponding to different engine speed-load conditions are higher than a threshold air-fuel error and have a common directionality (that is, both the port and the direct injector are either indicating a rich air-fuel error or a lean air-fuel error), then a portion of the error may be attributed to the common error. The common error may be learned as a minimum of the two ratios. The controller may then adjust the transfer function of each injector taking into account the common error. For example, the common error contribution may be removed during the transfer function adjustment. As a result, common error may be differentiated from fuel injector errors and accordingly compensated for.

The approach described here may confer several advantages. In particular, the approach allows errors that are common to both fueling systems to be distinguished from fueling errors of individual direct and port fuel injectors. Further, the common errors may be compensated for when adjusting the transfer function of direct and port fuel injectors for their individual errors. By separating individual fueling errors of the direct and port fuel injectors from the common error, air-fuel imbalances generated by overcompensation or under-compensation of fuel injector errors can be reduced. Further, the approach may reduce the erroneous disabling of non-degraded fuel injectors.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
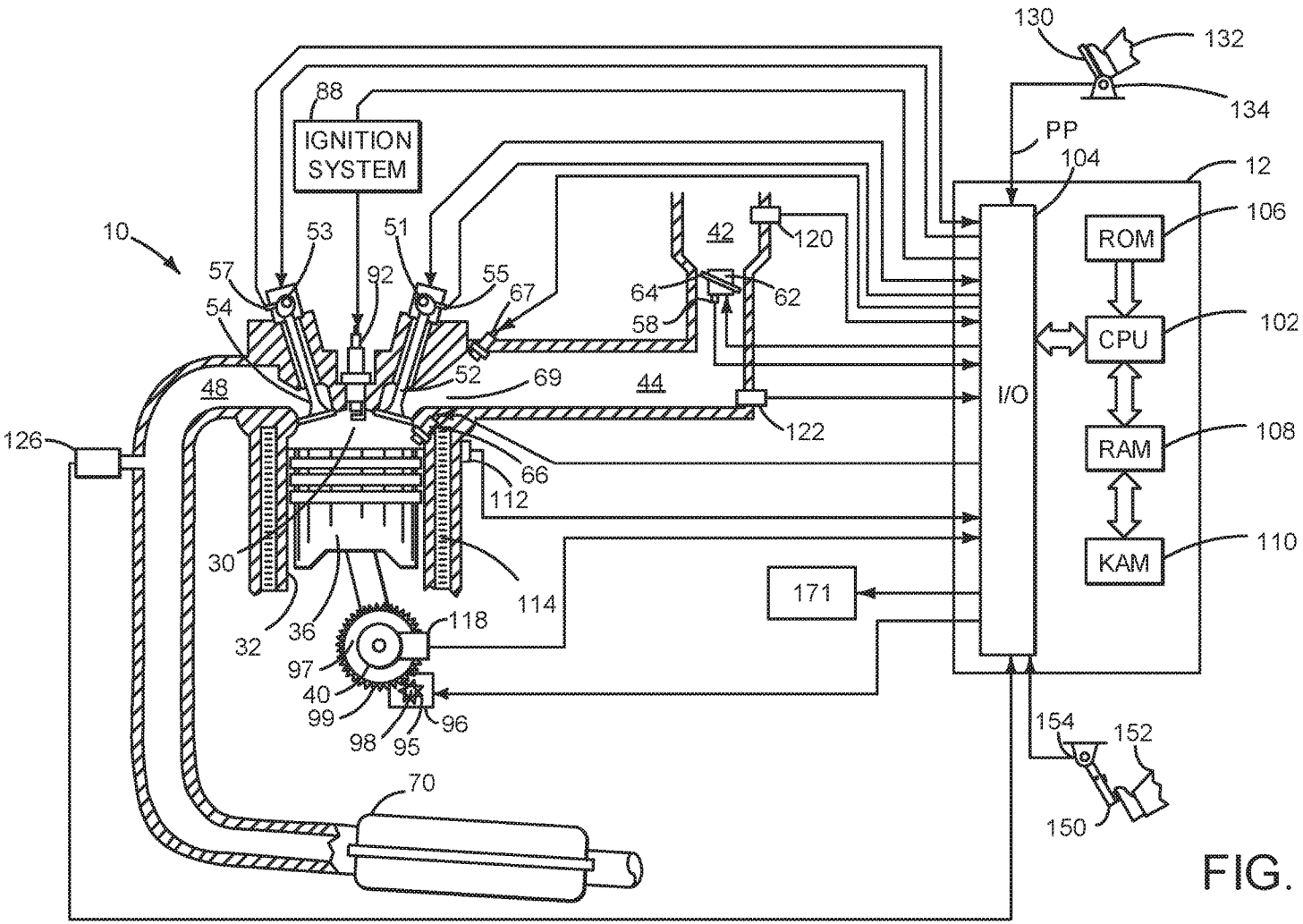
FIG. 1 is an illustration of an engine with a cylinder.
Figures 2A, 2B:
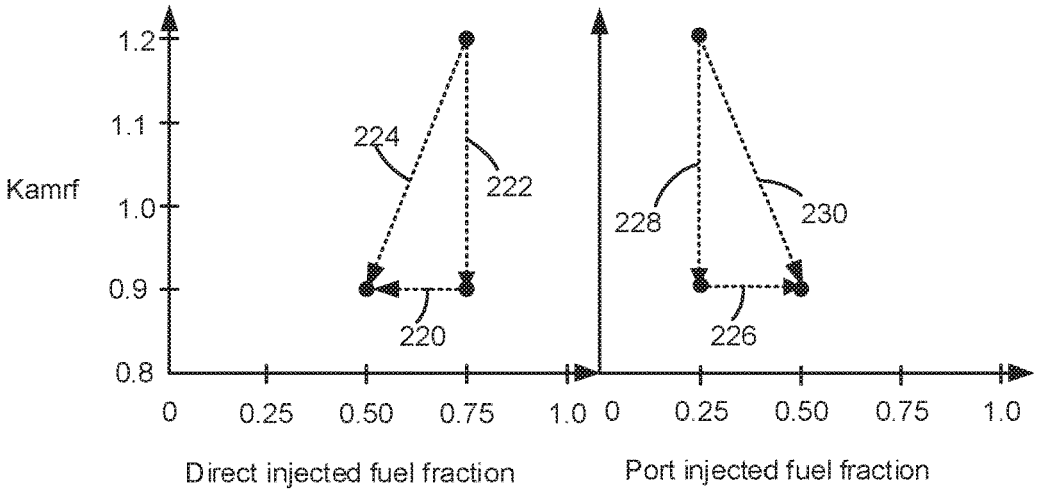
FIG. 2A shows an example table of adapted fuel multipliers.
FIG. 2B shows an example graphical output for determining fueling errors of a direct and port fuel injector.
Figure 2C:
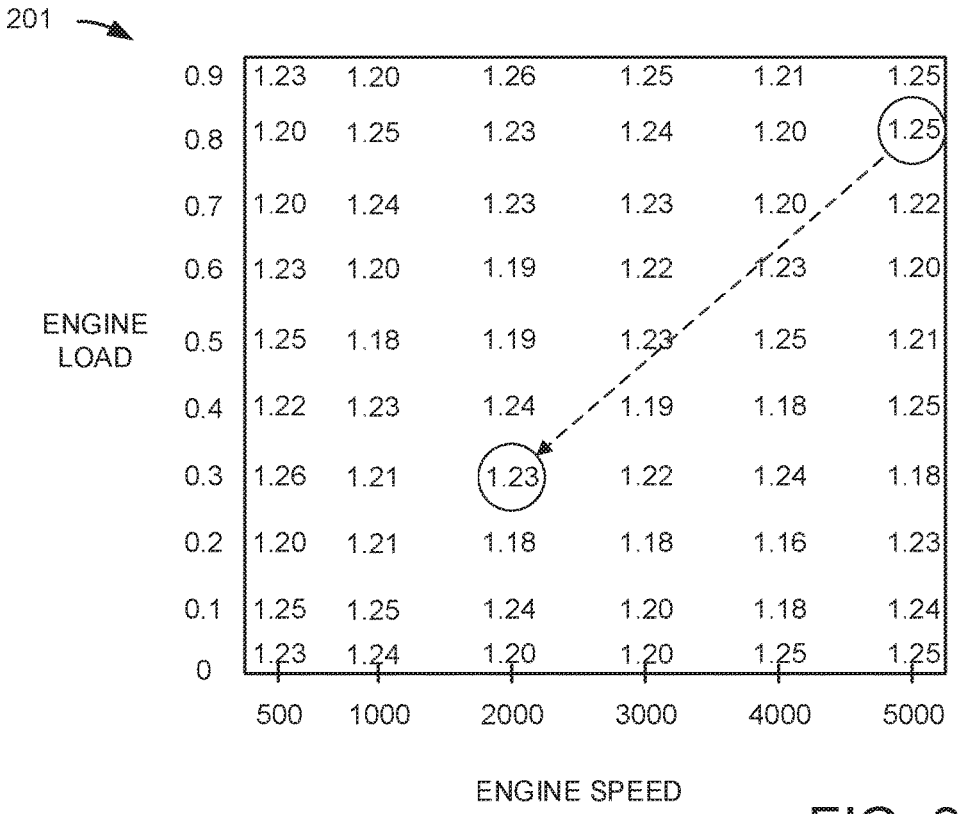
FIG. 2C shows an example table of adapted fuel multipliers used to determine a common error in an engine operating different speeds and loads.
Figure 2D:
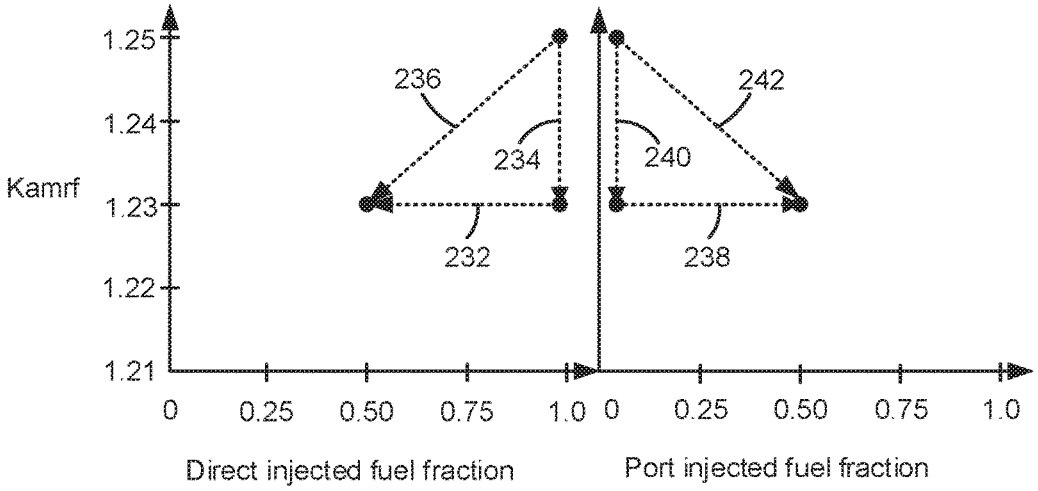
FIG. 2D shows an example graphical output for determining a common error in the engine.
Figure 4:
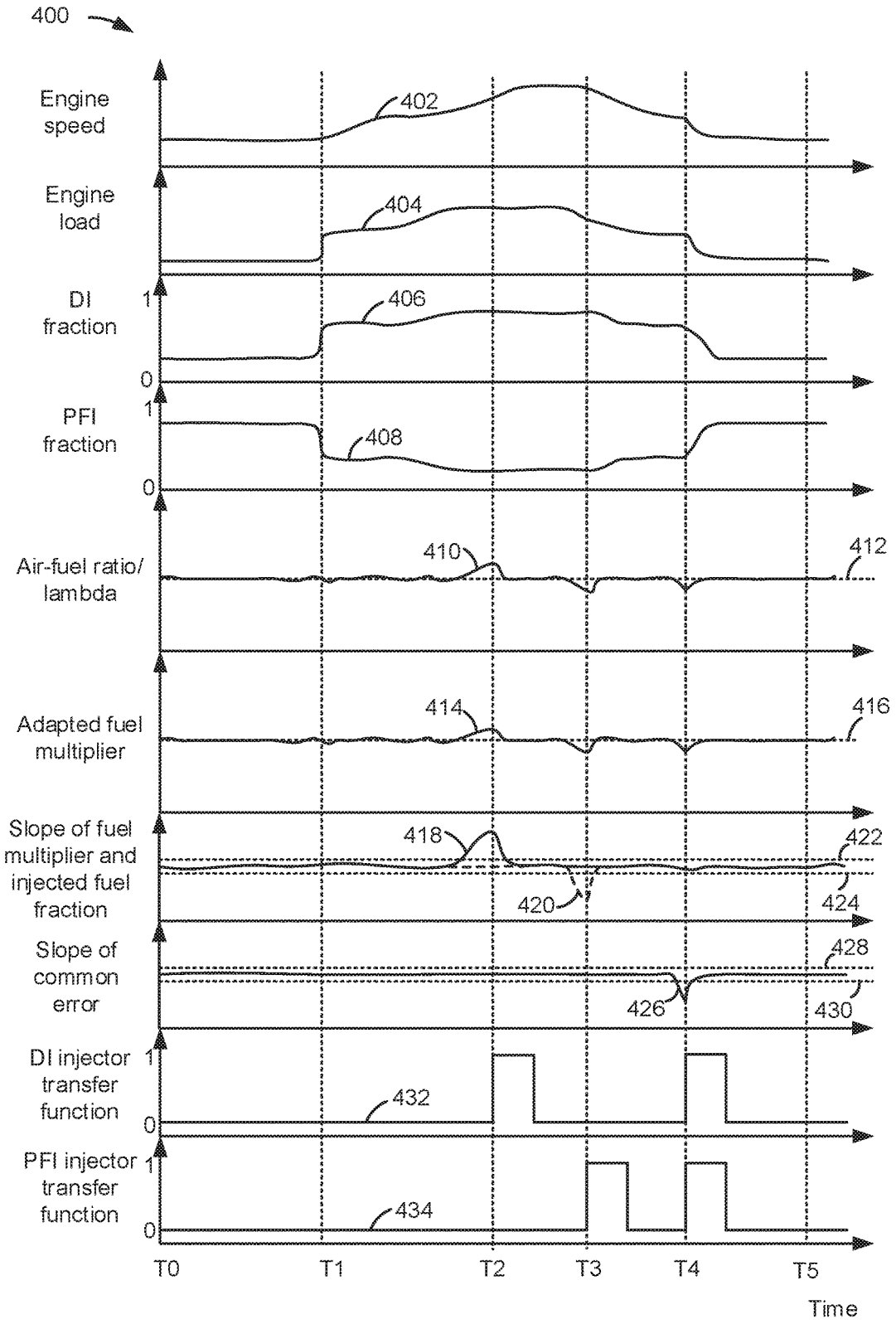
FIG. 4 shows an example graphical output for determining fueling error contributions from direct and port fuel injectors.
Figure 5:
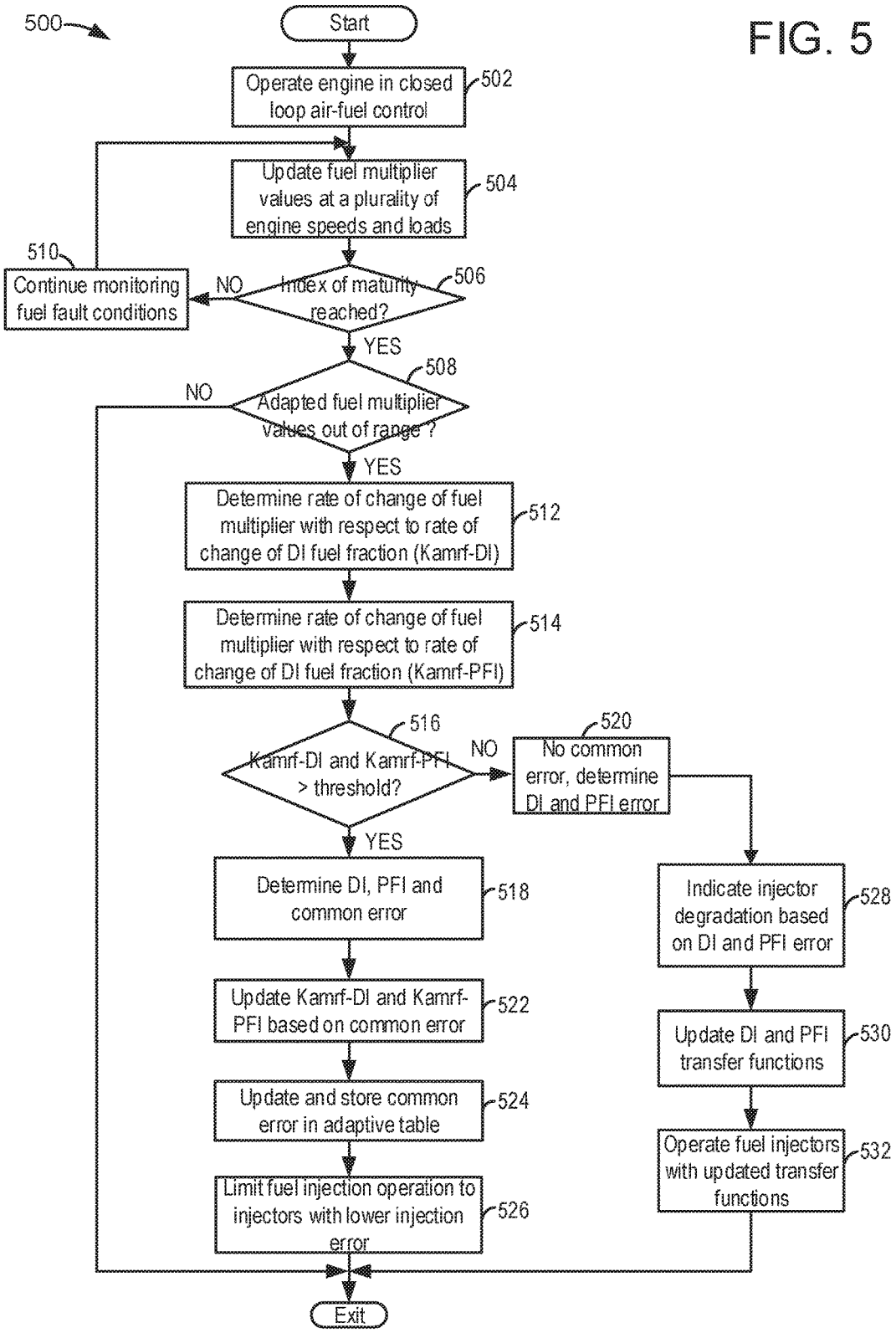
FIG. 5 shows an alternative method for determining direct and port fuel injector error, and common error in an engine.
Figure 6:
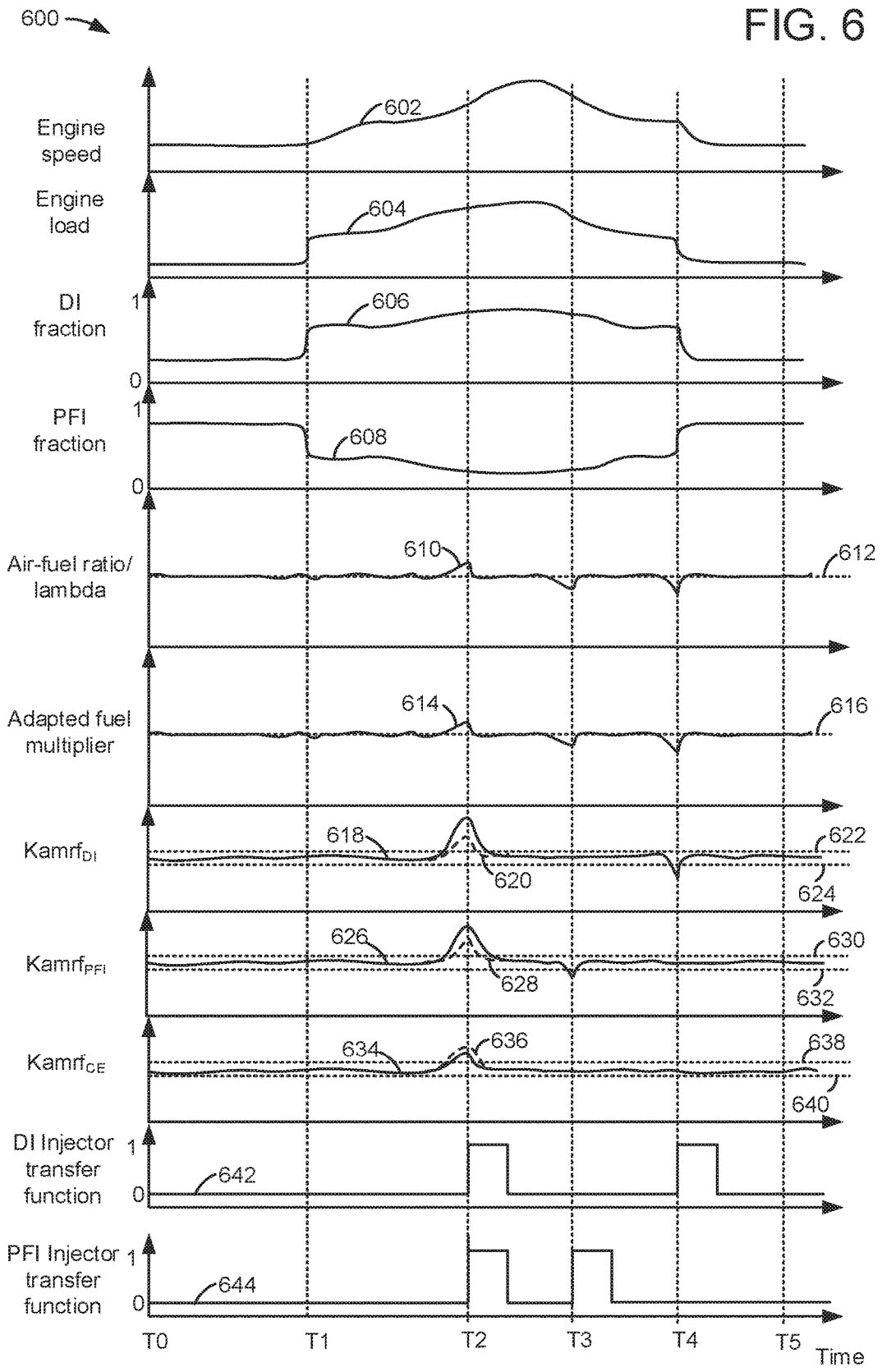
FIG. 6 shows an example graphical output for separating fueling error of direct and port fuel injectors from a common error.

The following description relates to systems and methods for determining air-fuel errors in an internal combustion engine with cylinders fueled by direct and port fuel injection. FIG. 1 depicts an engine cylinder fueled via direct and port fuel injection. FIG. 2A shows an example table of adapted fuel multiplier values. The adapted fuel multipliers may be used to indicate air-fuel error in an engine with direct and port fuel injectors. FIG. 2B shows an example graphical output for determining direct and port fuel injector error as a ratio of change in adapted fuel multiplier values relative to fraction of fuel injected via direct and port fuel injection, respectively. FIG. 2C shows an example table of adapted fuel multipliers used to determine a common error in an engine operating different speeds and loads. The common error may be indicated if values of the adapted fuel multipliers exceed a stoichiometric value of 1.0. FIG. 2D shows an example graphical output for determining a common error in the engine. An absolute slope of adapted fuel multipliers and fraction of fuel injected via direct and port fuel injectors indicates a magnitude of the common error. An engine controller may be configured to perform a control routine, such as the example routine of FIG. 3, to learn and distinguish a fuel injector error from a common error in the system of FIG. 1. FIG. 4 shows an example graphical output for distinguishing and correcting for a common error. FIG. 5 shows a method for determining individual contributions to an overall fueling error from each of a direct and port fuel injector, and a common error. An example graphical output for distinguishing and compensation for individual contributions is shown in FIG. 6.

Referring to FIG. 1, internal combustion engine 10, comprising a plurality of cylinders, one cylinder of which is shown in FIG. 1, may be controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 may be in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a pulse width of a signal from controller 12. Likewise, fuel injector 67 delivers liquid fuel in proportion to a pulse width from controller 12. Fuel is delivered to fuel injectors 66 and 67 by a fuel system (not shown) including a fuel tank, fuel pump, and fuel rail (not shown). Fuel may be supplied to direct fuel injector 66 at a higher pressure while fuel may be supplied to port fuel injector 67 at a lower pressure. In addition, intake manifold 44 may communicate with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Engine 10 of FIG. 1 may be fueled with different types of fuel. For example, engine 10 may be capable of using gasoline, diesel, ethanol, methanol, a mixture of gasoline and ethanol (e.g., E85 which is approximately 85% ethanol and 15% gasoline), a mixture of gasoline and methanol (e.g., M85 which is approximately 85% methanol and 15% gas), etc. In another example, engine 10 may use one fuel or fuel blend (e.g., gasoline or gasoline and ethanol) and one mixture of water and fuel (e.g., water and methanol). In yet another example, engine 10 may use gasoline and a reformate fuel generated in a reformer coupled to the engine.

Direct and port fuel injector fueling errors may occur in an engine operating under a wide range of conditions. Fuel injector fueling errors may result from clogged fuel injectors, a faulted fuel metering device, a degraded fuel injector pump, etc. Further, a common error which includes a common fuel type error and air error may also occur in an engine fueled via both direct and port fuel injection. The common error represents an air error or a fueling error that is observable simultaneously in both types of injectors as a fuel injector error, the error in both injectors occurring to the same degree and with the same directionality. A common fuel type error may occur due to degraded fuel, for example, and may cause both port and direct fuel injectors to provide a lower or larger fuel amount than expected. For example, if the viscosity of a fuel changes, the fuel injectors may inject a different amount of fuel than expected causing a fueling error. In another example, a common fuel type error may occur when the actual fuel injected into an engine is different from the expected fuel, such as when the oxygen content of a fuel injected into a flex fuel engine deviates from the oxygen content of the fuel refilled into the fuel tank. In one example, a fuel tank may be refilled with E10 and E10 is expected to be injected into the engine. However, due to the fuel tank being previously filled with E50, and a small amount of E50 remaining in the fuel tank when the fuel tank was refilled with E10, the final composition of fuel injected into the engine may have an alcohol content (and therefore an oxygen content) that is higher than E10. This can result in a common fuel-type error. A common air error, on the other hand, may occur due to a degraded engine sensor such as a mass air flow sensor, a pressure sensor or a throttle position sensor. Alternatively, a common air error may occur if some engine cylinders receive more air than other cylinders due to the particular location of the cylinders along an intake air passage, or due to the configuration of the intake manifold (e.g., the passage, the plenum, the runners, etc.). As elaborated at FIGS. 3-4, the engine controller may learn a fueling error and determine whether the fueling error is due to a direct injector fueling error, a port injector fueling error, or a common error. As elaborated at FIGS. 5-6, the engine controller may learn a fueling error and determine which portion of the fueling error is due to the direct injector fueling error, the port injector fueling error, and the common error. In each case, the common error may be differentiated based on a ratio of a rate of change of air-fuel error relative to a rate of change of a fraction of directly injected fuel, as well as a rate of change of a fraction of port injected fuel. In response to the different errors, distinct mitigating actions and transfer function compensations may be performed to enable the engine to be operated at a desired air-fuel ratio.

Distributorless ignition system 88 provides an ignition spark to combustion chamber 30 via spark plug 92 in response to controller 12. Universal Exhaust Gas Oxygen (UEGO) sensor 126 may be coupled to exhaust manifold 48 upstream of catalytic converter 70. Alternatively, a two-state exhaust gas oxygen sensor may be substituted for UEGO sensor 126.

In one example, the catalytic converter 70 may include multiple catalyst bricks. In another example, multiple emission control devices, each with multiple bricks, may be used. In yet another example, the catalytic converter 70 may be a three-way type catalyst.

Controller 12 is shown in FIG. 1 as a conventional microcomputer including: microprocessor unit 102, input/output ports 104, read-only memory (ROM) 106 (e.g., non-transitory memory), random access memory (RAM) 108, keep alive memory (KAM) 110, and a conventional data bus. Controller 12 may receive various signals from sensors coupled to engine 10, in addition to those signals previously discussed, including: engine coolant temperature (ECT) from temperature sensor 112; an accelerator pedal position signal from position sensor 134 coupled to accelerator pedal 130 operated by input 132; a brake pedal position signal from pedal position sensor 154 coupled to brake pedal 150 operated by input 152, engine manifold pressure (MAP) from pressure sensor 122; an engine position signal from Hall effect sensor 118 coupled to crankshaft 40; air mass entering the engine from sensor 120; and throttle position signal from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) may be determined. The controller 12 receives signals from the various sensors of FIG. 1 and employs the various actuators of FIG. 1 to adjust engine operation based on the received signals and instructions stored on a memory of the controller. For example, based on input from an exhaust gas sensor regarding an air-fuel ratio error, the controller may adjust a fuel multiplier for each fuel injector, and accordingly send an adjusted signal to a driver for each fuel injector to update a fuel injection pulse-width for each fuel injector.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of engine components to display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In this way, the system of FIG. 1 provides for a system, comprising: an engine including a cylinder; a port fuel injector in fluidic communication with a cylinder; a direct fuel injector in fluidic communication with the cylinder; an exhaust air-fuel ratio sensor; and a controller including executable instructions stored in non-transitory memory for: while operating the engine with closed loop air-fuel ratio control based on feedback from the air-fuel ratio sensor, differentiating an engine fueling error due to degradation of one or more of the port and the direct fuel injector from an engine fueling error due to a common error in airflow to both the port and the direct fuel injector based on a ratio of a change in air-fuel error to a change in fuel fraction from the port and the direct injector during engine fueling; and adjusting fueling via one or more of the port and direct fuel injection responsive to the differentiating.

The system of FIG. 1 also provides for a system comprising: an engine including a cylinder; a port fuel injector in fluidic communication with the cylinder; a direct fuel injector in fluidic communication with the cylinder; an exhaust air-fuel ratio sensor; and a controller including executable instructions stored in non-transitory memory for: while operating the engine with closed loop air-fuel ratio control based on feedback from the air-fuel ratio sensor, updating an adaptive fuel multiplier for each of the port and the direct injector with a correction factor based on a common error in airflow to both the port and the direct injector, the common error estimated based on a ratio of a change in air-fuel error to a change in fuel fraction from the port and the direct injector during engine fueling; and adjusting fueling via one or more of the port and direct fuel injection using the adaptive fuel multipliers.

Referring to FIG. 2A, an example table is shown with a plurality of adapted fuel multipliers determined at different engine loads and speed. The adapted fuel multiplier values may be used to indicate air-fuel error in an engine operating under a wide range of conditions. The example values of the adapted fuel multipliers depicted in Table 200 may be used to adjust fuel supplied to the engine as shown by equation below.

$$M_{fuel} = M_{air} \cdot \frac{Kamrf}{AF_{stoich}} \cdot Lam \quad \text{(Eq. 1)}$$

where $M_{fuel}$ is mass of fuel delivered to the engine, $M_{air}$ is mass of air inducted to engine, Kamrf is an adapted fuel multiplier value, $AF_{stoich}$ is a stoichiometric air-fuel ratio and Lam is a fuel correction parameter based on a measured air fuel error.

The horizontal axis in Table 200 represents engine speed, and engine speed increases from left to right. The vertical axis represents engine load, and engine load increases in the direction of the vertical axis. The horizontal axis in Table 200 partitions the table vertically into a plurality of cells that may be indexed via engine speed while the vertical axis partitions the table horizontally into the plurality of cells that may be indexed based on engine load. When the engine is operating nominally with no air-fuel error, Table 200 may be populated with unit values of adapted fuel multiplier which may be updated based on feedback from an exhaust gas sensor (such as exhaust sensor 126 at FIG. 1). The values of the adapted fuel multipliers may be updated based on a difference between an actual air-fuel ratio determined at the exhaust sensor and an expected air-fuel ratio. After updating the values of the adapted fuel multipliers, the updated values may be used to determine the amount of fuel delivered to engine cylinders. For example, the engine may be operating with an engine load of 0.3 and engine speed of 500 rpm. From Table 200, an adapted fuel multiplier value (corresponding to an engine load of 0.3 and speed of 500 rpm) may change from an initial value of 1.0 to 0.75. An engine air-fuel error of 0.25 (1.0−0.75) may be determined based on the above values of fuel multipliers. The air-fuel error of 0.25 may indicate a rich air-fuel variation. In an alternative example, an engine may be operating with a load of 0.8 and speed of 4000 rpm. From Table 200, an adapted fuel multiplier value (corresponding to an engine load of 0.8 and speed of 4000 rpm) may change from an initial value of 1.0 to 1.15. An engine air-fuel error of 0.15 (1.15−1.0) may be determined based on the above values of the selected fuel multipliers. The air-fuel error of 0.15 may indicate a lean air-fuel variation.

Referring now to FIG. 2B, an example graphical output is shown for determining fueling errors in an engine fueled via both direct and port fuel injection. The first plot shows adapted fuel multiplier values and fraction of directly injected fuel used to determine a direct injector error. The horizontal axis of the first plot represents a fraction of fuel injected into the engine via direct injection (DI). The fraction of directly injected fuel may vary from 0 (e.g., no directly injected fuel) to 1.0 (e.g., all fuel is directly injected). The second plot shows values of adapted fuel multiplier and fraction of port injected fuel used to determine a port fuel injector error. The horizontal axis of the second plot represents a fraction of port injected fuel (PFI). The fraction of fuel injected into engine via a port fuel injector may vary from 0 (e.g., no port injected fuel) to 1.0 (e.g., all fuel is port injected). The vertical axes of each plot represent values of adapted fuel multiplier (Kamrf), and Kamrf increases in a direction of each vertical axis.

In one example, an engine may initially operate at a speed of 2000 rpm and load of 0.4. From Table 200, an adapted fuel multiplier value corresponding to the engine speed of 2000 rpm and engine of load 0.4 may be determined as 0.90. After a given duration, the engine speed may increase to 5000 rpm and engine load may increase to 0.8, the corresponding fuel multiplier may reach a value of 1.20. As illustrated in the first plot, a fraction of directly injected fuel during the operating period may change from 0.75 to 0.50 as depicted by line 220 and corresponding values of the adapted fuel multiplier (Kamrf) may change from 1.2 to 0.9 as depicted by line 222. A slope 224 of the adapted fuel multiplier and fraction of directly injected fuel may be calculated to determine a direct injector error. Slope 224 may be determined as a ratio of change in Kamrf to a change in fraction of directly injected fuel to provide a value of 1.2 ((0.9−1.2)/(0.50−0.75)). The calculated DI slope may be compared to a threshold slope to determine if one or more direct injectors may be degraded. If the slope determined above is greater than the threshold slope, one or more direct injectors may be malfunctioning. For example, a threshold slope may be determined to be 1.15, but the calculated slope may be 1.2, then one or more direct injectors may be degraded since the calculated slope is greater than the threshold slope. Consequently, degradation of one or more direct fuel injectors may be indicated and a transfer function of the direct fuel injector may be adjusted to correct the fueling error.

Referring to the second plot, a fraction of fuel injected into the engine via a port fuel injector (under similar engine operating conditions as described in the first plot) may change from 0.25 to 0.50 as depicted by line 226 and corresponding values of adapted fuel multiplier may change from 1.2 to 0.9 as depicted by line 228. Slope 230 of adapted fuel multiplier values and fraction of port injected fuel may be calculated to determine a port injector error. Slope 230 may be determined as ratio of a change in Kamrf to a change in fraction of port injected fuel to provide a value of −1.2 ((0.9−1.2)/(0.50−0.25)). The calculated PFI slope may be compared to a threshold slope to determine if one or more port fuel injectors may be degraded. For example, the calculated absolute PFI slope may be 1.2 but a threshold slope may be determined to be 1.1, then one or more port fuel injectors may be degraded since the calculated slope is greater than the threshold slope. Consequently, degradation of one or more port fuel injectors may be indicated and a transfer function of the port fuel injector may be adjusted to compensate for the fueling error.

As shown in the above example, the slopes indicating error in the direct injectors and port fuel injectors are similar and higher than the threshold value, but with opposite directionality. In this case, the DI fueling system may be faulted rich and the PFI fueling system may be faulted lean. Alternatively, the DI fueling system may be faulted lean and the PFI fueling system may be faulted rich. The engine may be operated continuously at different speed-load conditions, and the DI slope may be determined as a ratio of change in the air-fuel error and change in the DI fuel fraction. Similarly, the PFI slope may be determined as a ratio of change in the air-fuel error and change in the PFI fuel fraction. Subsequently, values of the DI and PFI slopes may be used to slowly adapt or estimate each DI and PFI error, respectively, during engine operation.

Further, the slope of adapted fuel multiplier values and fraction of directly injected fuel may be compared with the slope of adapted fuel multiplier values and fraction of port injected fuel to determine if a common error is present. If the calculated DI and PFI error slopes are substantially equal, that is both injectors have a rich error or a lean error simultaneously, then a common error may be present as disclosed further with reference to FIGS. 2C-2D.

For example, an engine may be fueled by injecting fuel to a cylinder via a first fuel injector providing a first injection type (such as direct injection) and a second fuel injector providing a second injection type (such as pot injection). An engine controller may determine an air-fuel error based on a deviation of an actual exhaust air-fuel ratio (as estimated by an exhaust gas sensor) from an expected (or commanded) exhaust air-fuel ratio. The controller may then determine if the error is associated with the first fuel injector, the second fuel injector, or a common fuel system error as a function of a rate of change of the air-fuel ratio error relative to a fraction of fuel injected via the first fuel injector or the second fuel injector. The distinguishing the error associated with the first fuel injector or the second fuel injector from the common error may include the controller adapting the change of the air-fuel ratio error as a function of change in fraction of fuel injected via the first fuel injector to determine a first fueling slope error correction factor for the direct injector, while adapting the change of air-fuel ratio error as a function of change in fraction of fuel injected via the second fuel injector to determine a second fueling slope error correction factor for the port injector. If the first fuel slope error correction factor is higher than a threshold factor, it may be determined that the air-fuel error is due to a fueling error of the direct injector. If the second fuel slope error correction factor is higher than a threshold factor (e.g., the same threshold or a different threshold), it may be determined that the air-fuel error is due to a fueling error of the port injector. If both the port and direct injector errors are higher than the corresponding thresholds, and are directionally similar (i.e., either indicating a rich or lean correction in both the DI and PFI fueling systems), the controller may learn the air-fuel ratio error as the common error.

In still other examples, a portion of the total error may be learned as the common error if both the DI error and the PFI error are higher than a threshold and are faulted in the same direction (with the same slope). Therein the minimum of the two may be learned as the common error and individual contributions of the DI error and the PFI error to the total error may be accordingly learned and accounted for.

Referring to FIG. 2C, an example table 201 is shown with a plurality of adapted fuel multipliers determined at different engine load-speed conditions. The multiplier values in Table 201 exceed a stoichiometric multiplier value of 1.0, which may indicate presence of a common error. For example, an engine may operate at a speed of 5000 rpm and load of 0.8. An adapted fuel multiplier value corresponding to the engine speed of 5000 rpm and engine of load 0.8 may be determined from Table 201 as 1.25. In one example, fuel multipliers values exceeding a threshold value of 1.2 may indicate presence of a common error. Since the fuel multiplier value of 1.25 determined above exceeds the threshold value of 1.2, a common error may be present.

Turning now to FIG. 2D, an example graphical output is shown for determining a common error in an engine fueled via both direct and port fuel injection. The first plot shows adapted fuel multiplier values and DI fuel fraction used to determine the direct injector error. The horizontal axis of the first plot represents the fraction of fuel injected into the engine via direct injection. The fraction of directly injected fuel may vary from 0 (e.g., no directly injected fuel) to 1.0 (e.g., all fuel is directly injected). The second plot shows values of adapted fuel multiplier and fraction of port injected fuel used to determine a port fuel injector error. The horizontal axis of the second plot represents a fraction of port injected fuel (PFI). The fraction of fuel injected into engine via a port fuel injector may vary from 0 (e.g., no port injected fuel) to 1.0 (e.g., all fuel is port injected). The vertical axes of each plot represent values of adapted fuel multiplier (Kamrf), and Kamrf increases in a direction of each vertical axis.

For example, an engine may initially operate at a speed of 5000 rpm and load of 0.8. An adapted fuel multiplier value corresponding to the engine speed of 5000 rpm and engine of load 0.8 may be determined from Table 201 as 1.25. After a given duration, the engine speed may decrease from 5000 rpm to 2000 rpm and engine load may decrease from 0.8 to 0.3, and the corresponding fuel multiplier may decrease from 1.25 to 1.23 as shown in Table 201. In one example, fuel multipliers exceeding a threshold of 1.2 may indicate presence of a common error.

As illustrated in the first plot, a fraction of directly injected fuel during the operating period may change from 0.95 to 0.50 as depicted by line 232 and corresponding values of the adapted fuel multiplier (Kamrf) may change from 1.25 to 1.23 as depicted by line 234. A slope 236 of the adapted fuel multiplier values and fraction of directly injected fuel may be calculated. Slope 236 may be determined as a ratio of change in Kamrf to a change in fraction of directly injected fuel to provide a value of 0.04 ((1.23−1.25)/(0.50−0.95)). Since both fuel multiplier values are above the fuel multiplier threshold of 1.2, a common error may be deemed present. Further, the calculated absolute DI slope may be compared to an absolute PFI slope to determine a magnitude of the common error as disclosed below.

Referring to the second plot, a fraction of fuel injected into the engine via a port fuel injector (under similar engine operating conditions as described in the first plot) may change from 0.05 to 0.50 as depicted by line 238 and corresponding values of adapted fuel multiplier may change from 1.25 to 1.23 as depicted by line 240. Slope 242 of adapted fuel multiplier values and fraction of port injected fuel may be determined as ratio of a change in Kamrf to a change in fraction of port injected fuel to provide a value of −0.04 ((1.23−1.25)/(0.50−0.05)). The calculated absolute PFI slope may be compared to the absolute DI slope to determine the magnitude of the common error. For example, the calculated absolute PFI slope and DI slope are both equal to 0.04, indicating a common error of 0.04. Consequently, degradation of one or more direct and port fuel injectors may be indicated and transfer functions of both the direct and port fuel injectors may be adjusted to compensate for the common error. After the common error is identified, the fuel multipliers may be adjusted with a common error based correction factor.

Figure 3:
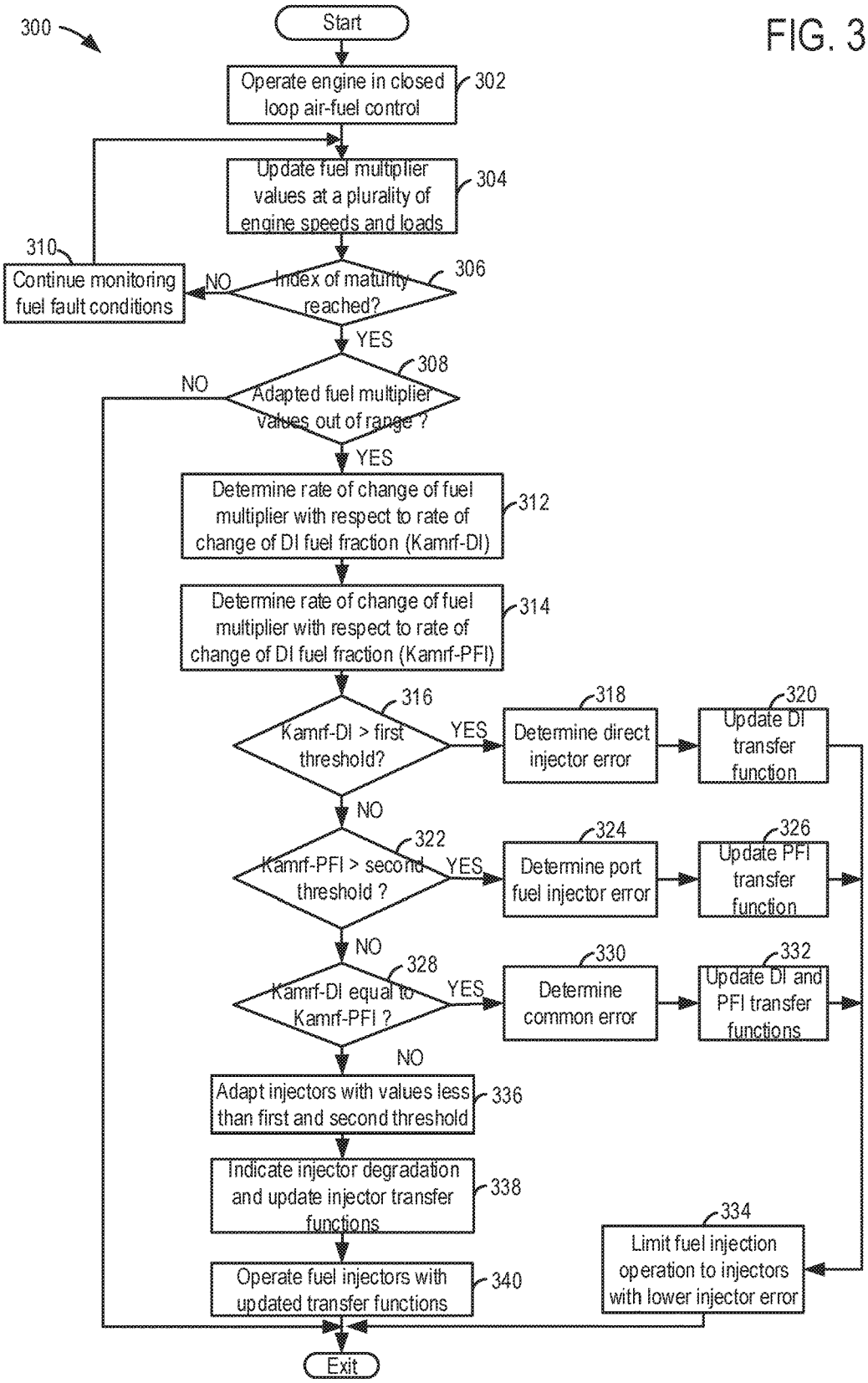
FIG. 3 shows a flowchart for determining fuel injector error and common error in an engine with direct and port fuel injectors.

Referring to FIG. 3, an example method 300 is shown for determining fueling errors in an engine with direct and port fuel injectors. The method enables an air-fuel error to be attributed to a direct injector or a port injector or a common error. Accordingly, distinct mitigating actions may be undertaken. A direct injector fuel error may be determined based on a first fuel slope correction factor determined based on a rate of change of adapted fuel multiplier values and fraction of fuel injected via direct fuel injection. A port fuel injector error may be determined based on a second fuel slope correction factor determined based on a rate of change of adapted fuel multiplier values and fraction of fuel injected via port fuel injection. By comparing the first and the second fuel slope correction factor, DI and PFI errors may be distinguished from a common error. Instructions for carrying out method 300 and the rest of the methods included herein may be executed by a controller based on instructions stored on a memory of the controller and in conjunction with signals received from sensors of the engine system, such as the sensors and output described above with reference to FIG. 1. The controller may employ engine actuators of the engine system to adjust engine operation, according to the methods described below.

At 302, an engine is operated in closed loop air-fuel control mode. During closed loop air-fuel control, a controller (such as controller 12 of FIG. 1) determines a desired engine air-fuel ratio by indexing tables and/or functions based on driver demanded torque, engine speed, engine load, and other engine operating conditions. Fuel may be injected into the engine via direct and/or port fuel injectors to provide the desired engine air-fuel ratio, and feedback from an exhaust gas sensor (such as exhaust gas sensor 126 at FIG. 1) may be used to adjust the amount of fuel injected. A fraction of fuel injected via the direct and port fuel injectors may also be determined based on engine load and speed, such as by indexing a look-up table. As an example, at lower engine speeds and loads, a larger portion of the total fuel amount may be delivered via port injection. As another example, at higher engine speeds and loads, a larger portion of the total fuel amount may be delivered via direct injection.

Next at 304, method 300 adapts a value of a fuel multiplier based on sensor readings at the exhaust gas sensor. The exhaust gas sensor may indicate a lean or rich air-fuel ratio depending on engine operating conditions. Specifically, if the exhaust gas sensor indicates a lean or rich air-fuel error over a duration greater than a threshold duration, an adapted fuel multiplier may be incremented or decremented from an initial unit value to a new reading based on a magnitude of air-fuel error measured at the exhaust gas sensor. The threshold duration may be determined based on a number of times fuel multiplier values have been adjusted. Alternatively, the threshold duration may be determined during the adaptive learning based on a difference between a current fuel multiplier and a previous fuel multiplier exceeding a threshold difference. The adapted fuel multiplier values may be learned at a plurality of engine speeds and loads, and at a plurality of engine air masses/mass flows, and stored in a memory of the engine controller. In addition, the fractions of fuel injected via direct and port fuel injectors, and the corresponding adapted fuel multiplier values and engine load-speed may be stored in the memory of the controller. After learning and adjusting fuel multiplier values at different engine speeds and loads, the routine proceeds to 306.

At 306, it may be determined if adaptive learning of fuel multiplier values has reached a mature learning limit. Learning maturity may be based on a number of times adapted fuel multiplier values have been updated. Alternatively, the mature learning limit may be reached if a difference between a current value and previous value of a fuel multiplier is larger than the threshold difference. Furthermore, the routine may determine if a sufficient number of adapted fuel multiplier values and corresponding fuel fractions injected via direct and port fuel injectors have been stored in the memory of the controller. If the adapting learning has reached the mature learning limit, the routine proceeds to 308. Otherwise, if the adapting learning has not matured, the routine proceeds to 310 to continue monitoring air-fuel ratio errors and fuel fault conditions.

Next at 308, the routine determines if any of the adapted fuel multiplier values are out of range. If the answer is YES, method 300 proceeds to 312. Otherwise, the answer is NO and the routine exits and no further adjustments are performed to the adaptive fuel multipliers. Next at 312, a slope of an adapted fuel multiplier and fraction of directly injected fuel may be determined at different engine loads and speeds. An engine may be operating with both direct and port fuel injectors providing fuel to the engine. Alternatively, the engine may be fueled via only direct fuel injection. For example, fuel may be injected in an engine via both direct and port fuel injectors when the engine is operating at mid-speed and load. In another example, the engine may be fueled via only direct injection when the engine is operating at high engine speed and load. An example slope is illustrated at FIG. 2B, where a slope of adapted fuel multiplier values and fraction of directly injected fuel is determined for an engine operating at speeds in a range of 2000-5000 rpm and engine loads in a range of 0.4-0.8. The slope of the adapted fuel multiplier values and fraction of directly injected fuel may be determined as:

$$Kamrf_{DI} = \frac{d(Kamrf)}{d(DI_{frac})} \quad \text{(Eq. 2)}$$

where $Kamrf_{DI}$ is a slope of the adapted fuel multiplier values and fraction of the directly injected fuel, Kamrf is the adapted fuel multiplier, $DI_{frac}$ is the fraction of directly injected fuel. A fuel slope correction factor for the direct fuel injector may be adaptively learned using the following equation:

$$Kamrf_{DI\text{-}new} = Kamrf_{DI\text{-}old} + \alpha_1[d(kamrf)] \quad \text{(Eq. 3)}$$

where $Kamrf_{DI\text{-}new}$ is an updated slope of the fuel multiplier values and DI fuel fraction, $Kamrf_{DI\text{-}old}$ is a previous slope of the fuel multiplier values and DI fuel fraction, and $\alpha_1$ is a first gain value whose magnitude is a function of DI fuel fraction.

At 314, the routine determines a slope of an adapted fuel multiplier and fraction of port injected fuel at different engine loads and speeds. For example, both direct and port fuel injectors may be providing fuel to an engine operating at mid-speed and load. In an alternative example, an engine may be fueled via only port fuel injection when the engine is operating at low engine speed and load. An example slope is illustrated at FIG. 2B, where a slope of adapted fuel multiplier values and fraction of port injected fuel is determined for an engine operating at speeds in a range of 2000-5000 rpm and engine loads in a range of 0.4-0.8. The slope of the adapted fuel multiplier values and fraction of port injected fuel may be determined as:

$$Kamrf_{PFI} = \frac{d(Kamrf)}{d(PFI_{frac})} \quad \text{(Eq. 4)}$$

where $Kamrf_{PFI}$ is the slope of the adapted fuel multiplier values and fraction of the port injected fuel and $PFI_{frac}$ is the fraction of port injected fuel. A fuel slope correction factor for port fuel injector may be adaptively learned using the following equation:

$$Kamrf_{PFI\text{-}new}=Kamrf_{PFI\text{-}old}+\alpha_2[d(kamrf)] \quad \text{(Eq. 5)}$$

where $Kamrf_{PFI\text{-}new}$ is an updated slope of the fuel multiplier values and PFI fuel fraction, $Kamrf_{PFI\text{-}old}$ is a previous slope of the fuel multiplier values and PFI fuel fraction, and $\alpha_2$ is a second gain value whose magnitude is a function of PFI fuel fraction.

At 316, the routine determines if the slope of the adapted fuel multiplier values and fraction of directly injected fuel ($Kamrf_{DI}$) is greater than a first threshold fueling slope error. The first threshold slope error may be based on a maximum rich or lean air-fuel ratio less than an air-fuel ratio value based on fuel emissions standard. Alternatively, it may be determined if an error correction coefficient for the direct fuel injection is higher than a first threshold slope. If the calculated slope is greater than the first threshold slope (or the error correction coefficient for DI is higher than the first threshold slope), the routine proceeds to 318. At 318, method 300 determines that the fueling error is due to a direct injector error. Further, a fueling error of one or more direct fuel injectors is determined by comparing the calculated DI slope with the first threshold slope. As an example, if the DI slope is 1.3, it may be determined that a more than 30% of rich correction is being applied for the DI fueling. Accordingly, it may be inferred that the DI fuel system is faulted lean. As another example, if the DI slope is 0.75, it may be determined that a more than 25% of lean correction is being applied for the DI fueling. Accordingly, it may be inferred that the DI fuel system is faulted rich.

In one example, the calculated DI slope may be determined as 1.4 but the first threshold slope may be determined as 1.15. Since, the calculated DI slope is greater than the threshold slope, one or more direct fuel injectors may be determined to be degraded. A look-up table in the engine controller's memory may be updated to record and store the magnitude of the direct injector error and identity of the degraded direct fuel injectors.

Next at 320, the routine updates a transfer function of the degraded direct fuel injectors to compensate for the DI error determined at 318. In one example, updating the DI transfer function may involve providing less or more fuel via direct injection depending on a magnitude and direction of the DI error. For example, if the DI error is determined to be a rich error, the DI transfer function may be updated to provide a leaner DI fuel injection. In an alternative example, updating the DI transfer function may involve adjusting a direct injector timing and duration depending on the magnitude and direction of the DI error. For example, if the DI error is determined to be a rich error, the DI transfer function may be updated to direct inject fuel earlier and/or for a shorter duration.

Returning to 316, if the slope of the adapted fuel multiplier values and fraction of directly injected fuel ($Kamrf_{DI}$) is less than the first threshold slope, it may be determined that the error is not due a direct injector fueling error and the routine proceeds to 322. At 322, the routine determines if the slope of the fuel multiplier values and fraction of port injected fuel ($Kamrf_{PFI}$) is greater than a second threshold slope. Alternatively, it may be determined if an error correction coefficient for the port fuel injection is higher than a second threshold. The second threshold slope may be based on the maximum rich or lean air-fuel ratio less than an air-fuel ratio value based on fuel emissions standard. The second threshold slope may be the same as the first threshold slope. Alternatively, they may be distinct. If the calculated PFI slope is greater than the second threshold slope (or the error correction coefficient is higher than the second threshold), the routine proceeds to 324. At 324, it may be determined that the fueling error is due to a port injector error. Further, a fueling error of one or more port fuel injectors may be determined by comparing the calculated PFI slope with the second threshold slope. As an example, if the PFI slope is 1.3, it may be determined that a more than 30% of rich correction is being applied for the PFI fueling. Accordingly, it may be inferred that the PFI fuel system is faulted lean. As another example, if the PFI slope is 0.75, it may be determined that a more than 25% of lean correction is being applied for the PFI fueling. Accordingly, it may be inferred that the PFI fuel system is faulted rich. For example, a calculated PFI slope may be determined as 1.2 but the second threshold slope may be determined as 1.1. Since, the calculated PFI slope is greater than the second threshold slope, one or more port fuel injectors may be determined to be degraded. After determining the PFI error, method 300 proceeds to 326.

At 326, the routine updates a transfer function of the degraded port fuel injectors to compensate for PFI error determined in 324. For example, updating the PFI transfer function may involve providing less or more fuel via port fuel injectors (depending on the magnitude and direction of the fueling error) to compensate for the PFI error. For example, if the PFI error is determined to be a rich error, the PFI transfer function may be updated to provide a leaner port fuel injection. Alternatively, updating the PFI transfer function may involve adjusting a port fuel injector timing and duration of the timing depending on the magnitude and direction of the PFI error. For example, if the PFI error is determined to be a rich error, the PFI transfer function may be updated to port inject fuel earlier and/or for a shorter duration.

Returning to 322, if the slope of the adapted fuel multiplier values and fraction of port injected fuel ($Kamrf_{PFI}$) is less than the second threshold slope, the routine proceeds to 328. Herein, it is determined that the air-fuel error is not due to a fueling error of the port injector or the direct injector. At 328, it may be determined if the slope of adapted fuel multiplier values and fraction of directly injected fuel ($Kamrf_{DI}$) is equal to the slope of adapted fuel multiplier values and fraction of port injected fuel ($Kamrf_{PFI}$). Alternatively, it may be determined if the error correction coefficients for both the DI and the PFI system have the same directionality (or sign). In one example, both slopes may be equal and/or both error correction coefficients may have the same directionality if the error for both the DI and the PFI system are rich (or both lean) over a range of air masses. That is, both fuel systems err the same way (with rich or lean) under the same operating condition. If both slopes are equal (i.e., $Kamrf_{DI}$ is equal to $Kamrf_{PFI}$), or both error correction coefficients have a common directionality, the routine proceeds to 330. At 330, method 300 determines that the air-fuel error is due to a common error in the engine system, such as a common fuel type error or an air measurement error. The common error may then be determined as a minimum of the DI error and the PFI error. For example, the common error, $Kamrf_{CE}$ may be determined as:

$$Kamrf_{CE}=\min\{(1-kamrf_{DI}),(1-Kamrf_{PFI})\} \quad \text{(Eq. 6)}$$

For example, the common error may be determined to include one or more of an airflow error associated with an airflow path delivering air to both the direct fuel injector and the port fuel injector, and a fuel-type error associated with the fuel injected by both the direct fuel injector and the port fuel injector. In another example, the common error may be a common fuel type error caused by changes in fuel quality resulting from changes in fuel temperature, density, viscosity and chemical composition. In other examples, the common error may be air error attributed to a degraded air sensor (such as mass air flow sensor 120, pressure sensor 122 and/or throttle position sensor 58 at FIG. 1). As such, the controller may not be able to differentiate a common error occurring due to a common fuel type error from a common error occurring due to an air error. In one example, an engine may be operating with both $Kamrf_{DI}$ and $Kamrf_{PFI}$ determined as 0.7 but a rich threshold level may be determined as 0.9. Since, both slopes are equal and outside the threshold error level, a rich common error of 0.3 (1.0−0.7) may be detected. After determining the common error, method 300 proceeds to 332.

At 332, the routine updates a transfer function of the direct and port fuel injectors to compensate for the common error determined at 330 as follows:

$$Kamrf_{DI\text{-}new}=Kamrf_{DI\text{-}old}+\text{common error} \quad \text{(Eq. 7)}$$

$$Kamrf_{PFI\text{-}new}=Kamrf_{PFI\text{-}old}+\text{common error} \quad \text{(Eq. 8)}$$

As shown in the above example, $Kamrf_{DI}$ and $Kamrf_{PFI}$ will change from 0.7 to 1.0 and the common error is taken as 0.3.

After determining one of the DI, PFI, and common error, method 300 proceeds to 334 (from each of 320, 326, and 332). At 334, the method includes applying distinct mitigating actions based on whether the system air-fuel error was due to a port injector error, a direct injector error, or a common error. In addition, distinct diagnostic codes may be set responsive to the indication of a DI error (or degraded direct injector), a PFI error (or degraded port injector), or a common error. For example, the routine may limit fuel injection to direct and port fuel injectors with lower fueling errors while disabling injectors with larger fueling errors. For example the error associated with the direct fuel injector may be compared to the error associated with the port fuel injector; and based on the comparison, one of the direct and port fuel injector having a larger error may be deactivated and the engine may be fueled with a remaining one of the direct and port fuel injector having a smaller error. As another example, if the direct injection system is determined to be degraded at 318, then responsive to the DI error, the controller may disable direct injection and fuel the engine via port injection only. Likewise, if the port injection system is determined to be degraded at 324, then responsive to the PFI error, the controller may disable port injection and fuel the engine via direct injection only. After updating the transfer functions of direct and port fuel injectors, the routine may exit.

Returning to 328, if the slope of the adapted fuel multiplier values and fraction of directly injected fuel ($Kamrf_{DI}$) is not equal to the slope of the adapted fuel multiplier values and fraction of port injected fuel ($Kamrf_{PFI}$), the routine proceeds to 336. At 336, the routine determines DI and PFI errors based on $Kamrf_{DI}$ and $Kamrf_{PFI}$ values less than the first and second threshold slopes, respectively. Next at 338, method 300 identifies degraded direct and port fuel injectors based on DI and PFI errors determined at 336. Further, the routine updates a transfer function of each degraded direct and port fuel injector to compensate for the DI and PFI error. After, identifying the degraded fuel injectors and updating the corresponding transfer functions, method 300 proceeds to 340. At 340, the routine operates fuel injectors with the updated transfer functions to deliver fuel to the engine, and subsequently the routine exits.

In this way, direct injector error may be identified based a first slope determined as a ratio of a rate of change of an air-fuel error and a fraction of fuel injected via direct injection, and a port fuel injector error may be identified based on a second slope determined as a ratio of a rate of change of an air-fuel error and a fraction of fuel injected via port injection. By comparing the first and second slope, the DI and PFI errors may be separated from a common error to reduce chances of over-compensating for engine air-fuel errors. Further, DI and PFI errors may be addressed by adjusting transfer functions of direct and port fuel injectors to reduce engine emissions and improve engine efficiency.

FIG. 4 shows an exemplary graphical output 400 for determining fuel injector error in an engine fueled with both direct and port fuel injectors. Method 400 will be described herein with reference to methods and systems depicted in FIGS. 1-3.

As illustrated, the first graph represents engine speed versus time at plot 402. The vertical axis represents engine speed and engine speed increases in the direction of the vertical axis. The second graph represents engine load versus time at plot 404. The vertical axis represents engine load and engine load increases in the direction of the vertical axis. The third graph represents a fraction of directly injected fuel versus time at plot 406. The vertical axis represents a fraction of directly injected fuel and the fuel fraction increases in the direction of the vertical axis. The fourth graph represents a fraction of port injected fuel versus time at plot 408. The vertical axis represents a fraction of port injected fuel and the fuel fraction increases in the direction of the vertical axis. The fifth graph represents engine air-fuel ratio or lambda versus time at plot 410. The vertical axis represents engine air-fuel ratio or lambda and air-fuel ratio or lambda increases in the direction of the vertical axis.

The sixth graph represents an adapted fuel multiplier versus time at plot 414. The vertical axis represents the adapted fuel multiplier and the value of the adapted fuel multiplier increases in the direction of the vertical axis. The seventh graph represents a slope of fuel multiplier values and a fraction of fuel injected via direct injection, and a slope of fuel multiplier values and a fraction of fuel injected via port injection versus time. The vertical axis represents the slope of fuel multiplier values and the fraction of directly injected fuel, the slope of fuel multiplier values and the fraction of port injected fuel, and both slopes increase in the direction of the vertical axis. Line 418 represents the slope of fuel multiplier values and the fraction of directly injected fuel and line 420 represents the slope of fuel multiplier values and the fraction of port injected fuel. Line 422 represent a threshold level for a lean injector error and line 424 represents a threshold level for a rich injector error. The eighth graph represents a slope of a common error versus time at plot 426. The common error may be a common fuel type error or air measurement error. The vertical axis represents the slope of the common error and the slope increases in the direction of the vertical axis. Line 428 represents a threshold level for a lean common error and line 430 represents a threshold level for a rich common error.

The ninth graph represents a transfer function of a direct injection system versus time at plot 432. The vertical axis represents the transfer function of a direct injection system and the transfer function increases in the direction of the vertical axis. The tenth graph represents a transfer function of a port fuel injection system versus time at plot 434. The vertical axis represents the transfer function of a port fuel injection system and the transfer function increases in the direction of the vertical axis. For lines 432 and 434, a value of "1" represents updating a transfer function of an engine injector and a value of "0" represents not updating a transfer function of an engine injector. The horizontal axes of each plot represent time and time increases from the left side of the figure to the right side of the figure.

Between T0 and T1, engine is operating at a lower engine speed (402) and engine load (404), and as a result a fraction of directly injected fuel (406) may be kept low and fraction of port injected fuel (408) may be maintained at a high level. Larger fractions of port injected fuel may be desirable at lower engine speeds and loads since fuel injected via port fuel injection quickly evaporates to reduce build-up of particulate matter and improve engine emissions. On the other hand, smaller fractions of directly injected fuel may be applied at low engine speeds and loads to reduce soot formation and spark plug fouling. The engine air-fuel ratio or lambda (410) measured at an exhaust gas sensor (such as exhaust gas sensor 126 at FIG. 1) is oscillating about a stoichiometric air-fuel ratio (412). The adapted fuel multiplier (414) may oscillate about an initial fuel multiplier value (416) corresponding to a condition with no engine air-fuel error. Since the engine air-fuel ratio is close to the stoichiometric level and the slopes of fuel multiplier values and fraction of injected fuel (for both direct and port fuel injectors) and the slope of common error do not exceed threshold values, the transfer functions of the direct injectors (432) and port fuel injectors (434) may not be updated.

At T1, the engine speed and load may increase in response to an increase in driver demand torque, for example. The fraction of directly injected fuel may increase while the fraction of the port injected fuel may decrease. Applying large fractions of directly injected fuel at higher engine speeds and loads may enhance cylinder charge cooling to reduce the possibility of engine knock. The engine air-fuel ratio may slightly decrease below the stoichiometric air-fuel ratio and adapted fuel multiplier value may slightly fall below the initial fuel multiplier value. The slopes of fuel multiplier values and fraction of injected fuel for both direct and port fuel injectors remain within threshold error levels. Likewise, the slope of the common error remains below threshold levels for the common error. Thus, adapting learning of fuel multiplier values may continue and the transfer functions of the direct and port fuel injectors may not be updated.

Between T1 and T2, the engine speed and load may continue to increase in response to an increase in driver demand torque. The fraction of directly injected fuel may continue to increase while the fraction of the port injected fuel may continue to decrease. The engine lambda continues to oscillate about the stoichiometric air-fuel ratio and the adapted fuel multiplier oscillates about the initial fuel multiplier value. The transfer functions of the direct and port fuel injectors may not be updated since the adapting learning has not reached a mature level. A learning maturity level may be determined based a learning duration exceeding a threshold duration. Alternatively, the maturity level may be determined based on a difference between current and previous fuel multiplier values exceeding a threshold fuel multiplier difference.

Prior to T2, the engine air-fuel ratio may increase above the stoichiometric air-fuel ratio and the adapted fuel multiplier may increase above the initial fuel multiplier value. Consequently, the slope of the adapted fuel multiplier values and fraction of directly injected fuel may increase and exceed the threshold level for a lean injector error while the slope of the adapted fuel multiplier values and a fraction of port injected fuel remains below threshold error values. The slope of common error may remain within threshold levels for the common error. Since the slope of the adapted fuel multiplier values and fraction of directly injected fuel exceeds the threshold level for the lean injector error, it may be determined that one or more direct fuel injectors may be degraded. An engine controller may be programed to store the magnitude of fueling error and identity of the degraded direct fuel injectors. The controller evaluates a change in the air fuel ratio from a closed loop controller or a change in the adaptive fuel multipliers and updates the DI slope ($Kamrf_{DI}$) as disclosed earlier at FIG. 3. Similarly, the controller evaluates a change in the air fuel ratio from the closed loop controller or the change in the adaptive fuel multipliers and updates the PFI slope ($Kamrf_{PFI}$) as disclosed earlier at FIG. 3. The controller may be further adjusted to update the transfer functions of the direct injectors during a subsequent engine operation. It may be further determined that none of the port fuel injectors are degraded since the slope of the adapted fuel multiplier values and fraction of port injected fuel is within threshold levels. Likewise, it may be determined that the common error is not present since the slope of common error is within threshold values.

In one example, the slope of fuel multiplier values and fraction of directly injected fuel may be determined as 1.3 but the threshold level for a lean injector error is 1.1. Since, the calculated DI slope correction factor is greater than the threshold level for a lean injector error, it may be determined that one or more direct fuel injectors may be degraded. Furthermore, the slope of fuel multiplier values and fraction of port injected fuel may be determined as 0.98 but a threshold level for a lean injector error is 1.1 and a threshold level for a rich injector error is 0.9. Since, the calculated PFI slope correction factor of 0.98 is within both threshold levels it may be determined that none of the port fuel injectors are degraded.

At T2, since one or more direct fuel injectors may be degraded, the transfer function (432) of the direct injectors may be updated by injecting a large fuel mass proportionate with the magnitude of the fueling error. The transfer function (434) of the port fuel injectors may not be updated since none of the port injectors exhibits any fueling error. The direct fuel injectors with large fueling error may be shut off and engine may be operated with direct injectors with lower error and revised transfer functions. Further, all port injectors may remain operational. Subsequently, the engine speed and load may continue to increase due to an increase in driver demand torque. The fraction of directly injected fuel may increase gradually while the fraction of port injected fuel may decrease slowly. The engine lambda may decrease to the stoichiometric air-fuel ratio and the adapted fuel multiplier may decrease to the initial fuel multiplier value. The slope of the adapted fuel multiplier and fraction of directly injected fuel may decrease to threshold levels while the slope of the adapted fuel multiplier and fraction of port injected fuel may remain within threshold levels. Likewise, the slope of the common error may remain within threshold levels.

Between T2 and T3, direct fuel injectors with low fueling error and updated transfer functions are operated to compensate for the fueling error determined previously at T2. The updating of the transfer functions of the direct fuel injectors may continue for a short duration before stopping. In addition, all the port fuel injectors remain operational. The engine speed and load may remain steady for a while before decreasing. The fractions of directly injected fuel maybe maintained at high levels while fractions of port injected fuel maybe kept at low values. The engine lambda continues to oscillate about the stoichiometric air-fuel ratio and the adapted fuel multiplier oscillates about the initial fuel multiplier value.

Prior to T3, the engine air-fuel ratio may decrease below the stoichiometric air-fuel ratio and the adapted fuel multiplier may decrease below the initial fuel multiplier value. But the slope of the adapted fuel multiplier values and fraction of directly injected fuel may remain within threshold levels. However, the slope of the adapted fuel multiplier values and a fraction of port injected fuel may drop below the threshold level for a rich injector error. The slope of common error may remain within threshold levels. Since the slope of the adapted fuel multiplier values and fraction of directly injected fuel is within threshold levels, it may be determined that none of the operating direct fuel injectors are degraded. However, one or more port fuel injectors may be degraded since the slope of the adapted fuel multiplier values and fraction of port injected fuel is outside the threshold level for a rich injector error. An engine controller may be programed to store the magnitude of fueling error and identity of the degraded port fuel injectors. The controller may be further adjusted to update the transfer functions of the port injectors in a subsequent engine operation. It may be further determined that no common error is not present since the slope of the common error is within threshold levels.

For example, the slope of fuel multiplier values and fraction of directly injected fuel may be determined as 0.95 but a threshold level for a lean injector error may be determined as 1.1 and a threshold level for a rich injector error may be 0.9. Since, the calculated slope is within the threshold error levels, it may be determined that none of the operating direct fuel injectors are degraded. Furthermore, the slope of fuel multiplier values and fraction of port injected fuel may be determined as 0.7 but the threshold level for a rich injector error may be 0.9. Since, the calculated slope of 0.7 is outside the threshold limit for the rich injector error, it may be determined that one or more of the port fuel injectors may be degraded, each degraded injector showing a rich PFI error.

At T3, since none of the operating direct fuel injectors are degraded, the transfer function of the direct injectors may not be updated. However, the transfer function of the port fuel injectors may be updated since one or more of the port injectors exhibit fueling error. Updating the transfer function of the port fuel injectors may include updating the amount of port injected fuel to compensate for the fueling error. The port fuel injectors with large fueling error may be shut off and engine may be operated with port fuel injectors with updated transfer functions. Between T3 and T4, port fuel injectors with low fueling error and updated transfer functions are operated to compensate for the fueling error determined previously. The updating of the transfer functions of the port fuel injectors may continue for a short duration before the updating process is stopped. In addition, all direct fuel injectors with lower error remain operational. Subsequently, the engine speed and load may decrease gradually due to a reduction in driver demand torque. The fraction of directly injected fuel may decrease gradually while the fraction of port injected fuel may increase slowly. The engine lambda may increase to the stoichiometric air-fuel ratio and the adapted fuel multiplier may increase to the initial fuel multiplier value. The slope of the adapted fuel multiplier and fraction of directly injected fuel may remain within threshold levels. But the slope of the adapted fuel multiplier and fraction of port injected fuel may increase to threshold levels. Further, the slope of the common error may remain within threshold levels.

Prior to T4, the engine air-fuel ratio may again decrease below the stoichiometric air-fuel ratio and the adapted fuel multiplier may decrease below the initial fuel multiplier value. The slope of the adapted fuel multiplier values and fraction of directly injected fuel may remain within threshold levels. Similarly, the slope of the adapted fuel multiplier values and a fraction of port injected fuel may remain within threshold levels. However, the slope of the common error may exceed the threshold for a rich common error and it may be determined that a rich common error is present. The common error may be a common fuel type error caused by changes in fuel quality, for example. Alternatively, the common error may be an air measurement error caused by a degraded sensor such as an air mass, pressure or throttle position sensor. The engine controller may set a diagnostic code to indicate the common error, the diagnostic code distinct from codes set responsive to a DI error or a PFI error. The controller may be further programed to update the transfer functions of the both direct and port fuel injectors in a subsequent engine operation to compensate for the common error.

At T4, the transfer functions of the direct and port fuel injectors may be updated due to the presence of the common error. Updating the transfer function of the direct and port fuel injectors may include updating the amount of fuel injected via both direct and port fuel injection to compensate for the common error. For example, the transfer function of the direct fuel injector may be adjusted in response to learning an air-fuel ratio error as an error associated with the direct fuel injector; the transfer function of the port fuel injector may be adjusted in response to learning an air-fuel ratio error as an error associated with the port fuel injector; and adjusting the transfer function of each of the direct fuel injector and the port fuel injector responsive to learning an air-fuel ratio error as a common error. In one example, direct and port fuel injectors with large fueling error may be shut off and engine may be operated with only fuel injectors with lower error. Subsequently, the engine speed and load may decrease to low values due to a further reduction in driver demand torque. The fraction of directly injected fuel may decrease to low value while the fraction of port injected fuel may increase to a high value. The engine lambda may increase to the stoichiometric air-fuel ratio and the adapted fuel multiplier may increase to the initial fuel multiplier value. The slope of the adapted fuel multiplier and fraction of injected fuel (for both direct and port fuel injectors) may remain within threshold levels. Further, the slope of the common error may increase and remain within threshold levels.

Between T4 and T5, direct and port fuel injectors with low fueling error may be operated to compensate for the common error determined prior to T4. The updating of the transfer functions of the direct and port fuel injectors may continue for a short duration before the updating process is stopped. The engine speed and load are maintained at low values. The fractions of directly injected fuel may remain at low values while fractions of port injected fuel may stay at high values. The engine lambda continues to oscillate about the stoichiometric air-fuel ratio and the adapted fuel multiplier oscillates about the initial fuel multiplier value.

In this way, direct injector error may be identified based on a slope of an air-fuel error and a fraction of fuel injected via direct injection, a port fuel injector error may be identified based on a slope of an air-fuel error and a fraction of fuel injected via port injection. By comparing the first and second slope, direct and port fuel injector errors may be separated from a common error to provide better estimates of engine air-fuel error. Further, fueling errors of direct and port fuel injectors may be addressed by adjusting DI and PFI transfer functions to reduce engine emissions and improve engine efficiency.

Referring to FIG. 5, an example method 500 is shown for determining fueling errors in an engine with direct and port fuel injectors. The method enables the portion of an air-fuel ratio error that is due to a common error to be differentiated from the portions of the error that is due to a direct injector and a port injector. Accordingly, direct and port injector transfer function adjustments may be updated to account for the common error portion. A fueling error of direct fuel injectors may be determined based on a slope of adapted fuel multiplier values and a fraction of directly injected fuel. Similarly, port injector error may be determined based on a slope of adapted fuel multiplier values and a fraction of port injected fuel. Further, a common error may be separated from direct and port fuel injector error based on a comparison of the DI and PFI slopes. In addition, fueling errors of the direct and port fuel injectors may be adjusted based on the common error. Instructions for carrying out method 500 and the rest of the methods included herein may be executed by a controller based on instructions stored on a memory of the controller and in conjunction with signals received from sensors of the engine system, such as the sensors and output described above with reference to FIG. 1. The controller may employ engine actuators of the engine system to adjust engine operation, according to the methods described below.

At 502, method 500 operates an engine in closed loop air-fuel control mode. During closed loop air-fuel control, a controller (such as controller 12 at FIG. 1) determines a desired engine air-fuel ratio by indexing tables and/or functions based on driver demand torque, engine speed, and other conditions. Fuel may be injected into the engine via direct and port fuel injectors to provide the desired engine air-fuel ratio and feedback from an exhaust gas sensor (such as exhaust gas sensor 126 at FIG. 1) may be used to adjust the amount of fuel injected. A fraction of fuel injected via direct and port fuel injectors may be determined based on engine load and speed, such as by indexing a look-up table. As an example, at lower engine speeds and loads, a larger portion of the total fuel amount may be delivered via port injection. As another example, at higher engine speeds and loads, a larger portion of the total fuel amount may be delivered via direct injection.

Next at 504, method 500 adapts a value of a fuel multiplier based on sensor readings at the exhaust gas sensor. The exhaust gas sensor may indicate a lean or rich fuel mixture depending on engine operating conditions. Specifically, if the exhaust gas sensor indicates a lean or rich air-fuel error over an extended duration, an adapted fuel multiplier may be incremented or decremented from an initial unit value to a new reading based on a magnitude of the measured air-fuel error. The adapted fuel multiplier may be learned at a plurality of engine speed and load conditions, as well as a range of engine air masses/air mass flows and stored in a memory of the controller. In addition, the fractions of direct and port injected fuel corresponding to the adapted fuel multiplier and engine speed-loads may be stored in the memory of the engine controller. After learning and adjusting fuel multiplier values at different engine loads and speeds, the routine proceeds to 506.

At 506, method 500 determines if the adaptive learning has reached a mature learning limit. The learning limit may be based on a number of times the adapted fuel multiplier values have been updated. Alternatively, the learning limit may be reached during the adapting learning if a difference between a current value and previous value of a fuel multiplier exceeds a threshold difference. Furthermore, the routine may determine if a sufficient number of adapted fuel multiplier values (and corresponding direct and port fuel fractions) have been stored in the memory of the engine controller. If the adapting learning has reached the mature learning limit, the routine proceeds to 508. Otherwise, if the adapting has not matured, the routine proceeds to 510 to continue monitoring air-fuel ratio errors and fuel fault conditions.

Next at 508, method 500 determines if any of the adapted fuel multiplier values are out of range. If the answer is YES and method 500 proceeds to 512. Otherwise, the answer is NO and no further adjustments are performed to the adaptive fuel multipliers. The routine then exits.

At 512, the routine determines a slope of an adapted fuel multiplier and fraction of directly injected fuel at different engine loads and speeds. An example slope is illustrated at FIG. 2B, where a slope of adapted fuel multiplier values and fraction of directly injected fuel is determined for an engine operating with speeds in a range of 500-5000 rpm and loads in a range of 0.4-0.8. The slope of the adapted fuel multiplier values and fraction of directly injected fuel may be determined as:

$$Kamrf_{DI} = \frac{d(Kamrf)}{d(F_{DI})} \quad \text{(Eq. 9)}$$

where $Kamrf_{DI}$ is a slope of the adapted fuel multiplier values and fraction of the directly injected fuel, Kamrf is the adapted fuel multiplier, $F_{DI}$ is the fraction of directly injected fuel. After determining the slope of the adapted fuel multiplier values and fraction of directly injected fuel, method 500 proceeds to 514.

At 514, the routine determines a slope of an adapted fuel multiplier and fraction of port injected fuel at different engine loads and speeds. An example slope is illustrated at FIG. 2B, where a slope of adapted fuel multiplier values and fraction of port injected fuel is determined for an engine operating at speeds in a range of 2000-5000 and loads in a range of 0.4-0.8. The slope of the adapted fuel multiplier values and fraction of port injected fuel may be determined as:

$$Kamrf_{PFI} = \frac{d(Kamrf)}{d(F_{PFI})} \quad \text{(Eq. 10)}$$

where $Kamrf_{PFI}$ is the slope of the adapted fuel multiplier values and fraction of the port injected fuel and $F_{PFI}$ is the fraction of port injected fuel. After determining the slope of the adapted fuel multiplier values and fraction of port injected fuel, method 500 proceeds to 516.

At 516, the routine determines if the absolute slope of the adapted fuel multiplier values and fraction of directly injected fuel ($Kamrf_{DI}$) and the absolute slope of the adapted fuel multiplier values and fraction of port injected fuel ($Kamrf_{PFI}$) is greater than a threshold slope. The threshold slope may be based on a maximum rich or lean air-fuel ratio less than an air-fuel ratio value based on fuel emissions standard. Alternatively, it may be determined if an error correction coefficient for each of the direct fuel injection and the port injection is higher than the threshold. If the calculated slope is greater than the threshold slope, the routine proceeds to 518. Otherwise, the routine proceeds to 520.

Next at 518, method 500 determines fueling error of direct and port fuel injectors and a common error. In this case, it may be assumed that the total error has a first direct injection error component, a second port injector error component, and a third common error component. Therefore, it may be desirable to separate the direct and the port fuel injector error from the common error to enable appropriate correction of DI and PFI transfer functions. For example, learning at least a portion of an air-fuel ratio error as a common error may include learning a first portion of the air-fuel ratio error as the common error and a second, remaining portion of the air-fuel ratio error as an error associated with a first port fuel injector and/or a second direct fuel injector, wherein the first portion is based on a minimum of a first slope of the PFI error and the second slope of the DI error, as elaborated below. The first fuel injector may be a direct fuel injector and the second fuel injector may be a port fuel injector.

In another example, degradation of a port fuel injector may be indicated when a ratio of a change in air-fuel error to a change in fuel fraction from the port fuel injector is higher than a threshold; degradation of a direct fuel injector may be indicated when a ratio of a change in air-fuel error to a change in fuel fraction from the direct fuel injector is lower than a threshold; an engine fueling error due to the common error may be indicated when the ratio of the change in air-fuel error to the change in fuel fraction from each of the port and the direct injector is higher than the threshold and the ratio of the change in air-fuel error to the change in fuel fraction from the port injector is within a threshold of the ratio of the change in air-fuel error to the change in fuel fraction from each of the direct injector. The air-fuel error may be determined based on a difference between a commanded air-fuel ratio and an actual air-fuel ratio estimated by the air-fuel ratio sensor, and wherein the change in air-fuel ratio error is learned as a change in an adapted fuel multiplier commanded to each of the port and the direct fuel injector.

The common error, $Kamrf_{CE}$ is determined based on a minimum value of a difference between a unit value and a calculated slope of each individual direct and port fuel injector as shown by the equation below.

$$Kamrf_{CE}=\min\{(1-Kamrf_{DI}),(1-Kamrf_{PFI})\} \quad \text{(Eq. 11)}$$

A correction for a fueling error in an engine may be made by adjusting fractions of fuel delivered via direct and port fuel injection as shown by the equation below.

$$Kamrf_{corr}=Kamrf_{DI}(F_{DI})+Kamrf_{PFI}(F_{PFI}) \quad \text{(Eq. 12)}$$

where, $Kamrf_{corr}$ is a fuel correction to compensate for DI and PFI error in an engine. However, if a common error is grouped together with fueling error of both direct and port fuel injectors, then the fuel correction shown in Eq. 8 may overcompensate for DI and PFI errors. Therefore, it is desirable to separate the common error from fueling error of direct and port fuel injectors prior to correcting for engine air-fuel error. For example, an engine may be fueled by injecting fuel to a cylinder via a first fuel injector and a second fuel injector; and an error associated with the first fuel injector or the second fuel injector is distinguished from a common fuel system error as a function of a rate of change of air-fuel ratio error and a fraction of fuel injected via the first fuel injector or the second fuel injector, as elaborated with reference to FIG. 6. Further, injecting fuel into the cylinder may be performed in each of a plurality of engine air mass flow regions and wherein the error associated with the first fuel injector or the second fuel injector and the common fuel system error is learned in each of the plurality of engine air mass flow regions as a function of air mass flow.

In other examples, fuel may be injected into an engine cylinder via a first fuel injector and a second fuel injector during a cylinder cycle, the first and second fuel injector having distinct types of fuel injection; and then selectively assigning an air-fuel error from the cylinder during the cylinder cycle to a common error associated with the fuel system based on each of a first fuel fraction provided by the first fuel injector, a second fuel fraction provided by the second fuel injector, and the air-fuel error. In one example, the selective assigning of the air-fuel error from the cylinder may further include learning a first rate of change in the air-fuel error with a change in the first fuel fraction; learning a second rate of change in the air-fuel error with a change in the second fuel fraction; and if the first rate is within a threshold difference of the second rate, and each of the first and second rate are higher than a threshold, assigning the air-fuel error to the common error. In another example, the selective assigning of the air-fuel error from the cylinder may further include assigning a first portion of the air-fuel error to the first fuel injector if the first rate is outside the threshold difference of the second rate while the first and the second are higher than the threshold, the first portion based on the first fuel fraction provided by the first fuel injector; and assigning a second portion of the air-fuel error to the second fuel injector, the second portion based on the second fuel fraction provided by the second fuel injector. In other examples, the selective assigning of the air-fuel error may further include assigning an adapted fuel multiplier corresponding to the common error to each of the first and the second fuel injector; wherein the adapted fuel multiplier corresponding to the common error is a first multiplier that is distinct from a second multiplier corresponding to the first portion of the air-fuel error that is assigned to only the first fuel injector, and is also distinct from a third multiplier corresponding to the second portion of the air-fuel error that is assigned to only the second fuel injector.

Next at 522, method 500, may update the slope of adapted fuel multipliers and a fraction of directly injected fuel to account for a portion of the common error grouped together with the direct injector error. Similarly, the slope of adapted fuel multipliers and fraction of port injected fuel may be updated to account for a portion of the common error that may be grouped together with the port fuel injector error. An updated slope of the adapted fuel multipliers and a fraction of fuel injected via direct injector ($Kamrf_{DI_new}$) and an updated slope of the adapted fuel multipliers and a fraction of fuel injected via port fuel injector ($Kamrf_{PFI_new}$) may be determined at each cell of the adaptive fuel multiplier table by subtracting the common error from values of $kamrf_{DI}$ determined at 512 (renamed hereafter as $Kamrf_{DI_old}$) and $Kamrf_{PFI}$ determined at 514 (renamed hereafter as $Kamrf_{PFI_old}$), as show in equations below.

$$Kamrf_{DI_new}=Kamrf_{DI_old}-Kamrf_{CE} \quad \text{(Eq. 13)}$$

$$Kamrf_{PFI_new}=Kamrf_{PFI_old}-Kamrf_{CE} \quad \text{(Eq. 14)}$$

For example, a slope of adapted fuel multiplier values and a fraction of directly injected fuel ($kamrf_{DI}$) may be determined as 1.6. Similarly, a slope of adapted fuel multiplier values and a fraction of port injected fuel ($kamrf_{PFI}$) may be determined as 1.3. A common error of 0.3 may be determined based on the DI and PFI slopes. By subtracting the common error of 0.3 from the individual direct and port fuel injector errors, an updated DI slope of 1.3 (1.6−0.3) and updated PFI slope of 1.0 (1.3−0.3) may be determined. Further, a threshold slope may be determined as 0.6, and threshold levels for a rich and a lean injector error may be determined as 0.9 and 1.1, respectively. The updated DI slope is determined to be greater than the threshold slope and the threshold level for a lean injector error. Therefore, it may be determined that a lean direct fuel injector error may be present. The PFI slope is determined to be greater than the threshold slope but within the threshold levels for the rich and lean injector error. Therefore, it may be determined that none of the port fuel injectors are degraded. In this way, direct and port fuel injector errors may be separated from the common error to minimize overcompensating for fueling errors while improving engine emissions.

Next at 524, the routine updates the common error in each cell of the adaptive fuel multiplier table based on a portion of the common error grouped together with the direct and port fuel injector errors. The routine determines a corrected common error ($Tcorr_{new}$) at each cell of the adaptive fuel multiplier table by adding the common error ($Kamrf_{CE}$) determined at 518 to a portion of a common error that may be grouped together with the fueling error of both direct and port fuel injectors (Tcorr) as shown in the equation below. The corrected common error is then stored in each cell of the adapted fuel multiplier table. The common error is directly added to the adaptive multiplier table disclosed in FIG. 2A.

$$Tcorr_{new}=Tcorr+Kamrf_{CE} \quad \text{(Eq. 15)}$$

At 526, the routine operates engine with direct and port fuel injectors with lower fueling error. In this case, both direct and port fuel injectors with large fueling error may be disabled. In one example, a first fuel injector or a second fuel injector may be operated in response to a greater of a first portion and a second portion of an air-fuel error. In another example, fuel injected into an engine may be adjusted to update an adapted fuel multiplier commanded to a direct fuel injector while disabling a port injector responsive to degradation of the port fuel injector; and an adapted fuel multiplier commanded to a port fuel injector may be updated while disabling a direct injector responsive to degradation of the direct fuel injector. The routine proceeds to exit after adjusting engine to operate with direct and port fuel injectors with lower error.

Returning to 516, if the routine determines that the slope of adapted fuel multipliers and fraction of directly injected fuel is not greater than the first threshold slope, method 500 proceeds 520. At 520, method 500 determines that there is no common error. Further, fueling error of direct and port fuel injectors may be determined based on absolute values of $Kamrf_{DI}$ and $Kamrf_{PFI}$ less than the first threshold. In this case, the DI and PFI errors may be smaller than fuel injector errors determined earlier at 518. Next at 528, degradation of direct and port fuel injector may be indicated based on direct and port fuel injector errors. For example, a slope of adapted fuel multiplier values and a fraction of directly injected fuel may be determined as 0.75. Similarly, a slope of adapted fuel multiplier values and a fraction of port injected fuel may be determined as 0.98. Further, a threshold slope may be determined as 0.8, and a threshold level for a rich and lean injector error may be determined as 0.9 and 1.1, respectively. The DI slope is determined to be less than the threshold slope and the outside the threshold level for the rich injector error. Therefore, it may be determined that a rich DI error may be present. The PFI slope is determined to be greater than the threshold slope and within the threshold levels for injector error. Therefore, it may be determined that none of the port fuel injectors are degraded.

At 530, the routine updates transfer functions of direct and port fuel injectors indicating degradation. The updating may include injecting a predetermined fuel amount into engine to compensate for any fuel injector error determined at 520. For example, if a lean DI error is indicated, an engine controller may be adjusted to inject more fuel into the engine to compensate for the DI error. Alternatively, the engine controller may be adjusted to inject less air into engine to compensate for the DI error. Next at 532, method 500 operates fuel injectors with updated transfer functions and proceeds to exit.

In this way, fueling error of direct and port fuel injectors delivering fuel to an engine may be determined based on a ratio of a rate of change of fuel multiplier values and fractions of injected fuel at different engine operating conditions. One or more direct fuel injectors may be degraded if the slope of the fuel multiplier values and fraction of directly injected fuel exceeds a first threshold slope. Likewise, one or more port fuel injectors may be degraded if the slope of fuel multiplier values and fraction of port injected fuel exceeds a second threshold slope. By comparing the ratio of the rate of change of air-fuel error and fuel fraction of the direct and port fuel injection systems, a common fuel type or air measurement error may be determined. In this way, it may be possible to distinguish between fueling errors of direct and port fuel injection systems from common error.

Referring to FIG. 6, an exemplary graphical output 600 is shown for determining fuel injector error and common error in an engine fueled via both direct and port fuel injectors. Method 600 will be described herein with reference to methods and systems depicted in FIGS. 1-2, and FIG. 5.

As illustrated, the first graph represents engine speed versus time at plot 602. The vertical axis represents engine speed and engine speed increases in the direction of the vertical axis. The second graph represents engine load versus time at plot 604. The vertical axis represents engine load and engine load increases in the direction of the vertical axis. The third graph represents a fraction of directly injected fuel versus time at plot 606. The vertical axis represents a fraction of directly injected fuel and the fuel fraction increases in the direction of the vertical axis. The fourth graph represents a fraction of port injected fuel versus time at plot 608. The vertical axis represents a fraction of port injected fuel and the fuel fraction increases in the direction of the vertical axis. The fifth graph represents engine air-fuel ratio or lambda versus time at plot 610. The vertical axis represents engine air-fuel ratio or lambda and air-fuel ratio or lambda increases in the direction of the vertical axis.

The sixth graph represents an adapted fuel multiplier versus time at plot 614. The vertical axis represents the adapted fuel multiplier and the value of the adapted fuel multiplier increases in the direction of the vertical axis. The seventh graph represents a slope of fuel multiplier values and a fraction of directly injected fuel ($kamrf_{DI}$) versus time at plot 618. The vertical axis represents the slope of fuel multiplier values and the fraction of directly injected fuel and the slope increases in the direction of the vertical axis. Line 622 represents a lean threshold level for the direct fuel injector and line 624 represents a rich error threshold level for the direct fuel injector. The eighth graph represents a slope of fuel multiplier values and a fraction of port injected fuel ($kamrf_{PFI}$) versus time at plot 626. The vertical axis represents the slope of fuel multiplier values and the fraction of port injected fuel and the slope increases in the direction of the vertical axis. Line 630 represents a lean threshold level for the port fuel injector and line 632 represents a rich threshold level for the port fuel injector.

The ninth graph represents a slope of a common error versus ($kamrf_{CE}$) time at plot 634. The common error may be a common fuel type error or air measurement error. The vertical axis represents the slope of the common error and the slope increases in the direction of the vertical axis. Line 638 represents a lean threshold level and line 640 represents a rich threshold level of the common error.

The tenth graph represents a transfer function of a direct injection system versus time at plot 642. The vertical axis represents the transfer function of a direct injection system and the transfer function increases in the direction of the vertical axis. The eleventh graph represents a transfer function of a port fuel injection system versus time at plot 644. The vertical axis represents the transfer function of a port fuel injection system and the transfer function increases in the direction of the vertical axis. For lines 632 and 644, a value of "1" represents updating a transfer function of an engine injector and a value of "0" represents not updating a transfer function of an engine injector. The horizontal axes of each plot represent time and time increases from the left side of the figure to the right side of the figure.

Between T0 and T1, engine is operating at a lower engine speed (602) and engine load (604), and as a result a fraction of directly injected fuel (606) may be kept low and fraction of port injected fuel (608) may be maintained at a high level. Larger fractions of port injected fuel may be desirable at lower engine speeds and loads since fuel injected via port fuel injector quickly evaporates to reduce buildup of particulate matter and improve engine emissions. On the other hand, small fractions of directly injected fuel are applied at low engine speeds and loads to reduce soot formation and spark plug fouling. The engine air-fuel ratio or lambda (610) measured at an exhaust gas sensor (such as exhaust gas sensor 126 at FIG. 1) is oscillating about a stoichiometric air-fuel ratio (612). The adapted fuel multiplier (614) may oscillate about an initial fuel multiplier value (616) corresponding to a condition with no engine air-fuel error. Since the engine air-fuel ratio is close to stoichiometric and the slope of fuel multiplier values and fraction of fuel injected (via both direct and port fuel injectors) and the slope of a common error is within threshold levels for common error, the transfer functions of the direct injectors (642) and port fuel injectors (644) may not be updated.

At T1, the engine speed and load may increase in response to an increase in driver demand torque, for example. The fraction of directly injected fuel may increase while the fraction of the port injected fuel may decrease. Applying large fractions of directly injected fuel at higher engine speeds and loads may enhance cylinder charge cooling to reduce the possibility of engine knock. The engine air-fuel ratio may slightly decrease below the stoichiometric level and the adapted fuel multiplier may slightly fall below the initial fuel multiplier value. The slopes of fuel multiplier values and fraction of fuel injected via both direct and port fuel injectors ($kamrf_{DI}$ and $kamrf_{PFI}$) may remain below threshold levels. Likewise, the common error ($kamrf_{CE}$) may remain below threshold levels. The adapting learning of fuel multiplier values may continue and the transfer functions of the direct and port fuel injectors may not be updated.

Between T1 and T2, the engine speed and load may continue to increase in response to an increase in driver demand torque. The fraction of directly injected fuel may continue to increase while the fraction of the port injected fuel may continue to decrease. The engine air-fuel ratio continues to oscillate about the stoichiometric level and the adapted fuel multiplier oscillates about the initial fuel multiplier value. The transfer functions of the direct and port fuel injectors may not be updated since the adapting learning has not reached a mature level. A learning maturity level may be determined based on a learning duration exceeding a threshold duration. Alternatively, the learning maturity level may be determined based on a difference between current and previous fuel multiplier values exceeding a threshold fuel multiplier difference.

Prior to T2, the engine air-fuel ratio may increase above the stoichiometric level and the adapted fuel multiplier may increase above the initial fuel multiplier value. Consequently, the direct and port injected fuel errors ($kamrf_{DI}$ and $kamrf_{PFI}$) may increase and exceed the lean error threshold level. Similarly, the common error ($kamrf_{CE}$) may also increase and exceed the lean common error threshold level. Since the direct and port fuel injector errors exceed threshold error levels, it may be determined that one or more direct and port fuel injectors may be degraded. In addition to presence of both direct and port fuel injector errors, it may also be determined that a common error is present. However, the DI and PFI errors determined, may include a portion of the common error. Therefore, there may be need to separate the common error from the DI and PFI errors determined prior to T2. In this case, a portion of the common error lumped together with the DI error (618) is separated out and an updated DI error may be determined as shown by dotted curve 620. Further, a portion of the common error lumped together with the PFI error (626) is separated out and an updated PFI error may be determined as shown by dotted curve 628. Similarly, the portion of the common error separated from the DI error (618) and PFI error (626) may be added to the original common error (634) to determine an updated common error (636).

For example, learning at least a portion of an air-fuel ratio error as a common error may include learning a first portion of the air-fuel ratio error as the common error and a second, remaining portion of the air-fuel ratio error as an error associated with the direct or the port fuel injector, wherein the first portion is based on a minimum of the first slope and the second slope. In another example, an engine may be fueled by injecting fuel to a cylinder via a direct fuel injector and a port fuel injector; and an error associated with the direct fuel injector or the port fuel injector is distinguished from a common fuel system error as a function of a rate of change of air-fuel ratio error and a fraction of fuel injected via the direct fuel injector or the port fuel injector. Further, injecting fuel into the cylinder may be performed in each of a plurality of engine air mass flow regions and wherein the error associated with the direct fuel injector or the port fuel injector and the common fuel system error is learned in each of the plurality of engine air mass flow regions as a function of air mass flow.

In other examples, fuel may be injected into an engine cylinder via a direct fuel injector and a port fuel injector during a cylinder cycle, the direct and port fuel injector having distinct types of fuel injection; and then selectively assigning an air-fuel error from the cylinder during the cylinder cycle to a common error associated with the fuel system based on each of a first fuel fraction provided by the direct fuel injector, a second fuel fraction provided by the port fuel injector, and the air-fuel error. In one example, the selective assigning of the air-fuel error from the cylinder may further include learning a first rate of change in the air-fuel error with a change in the first fuel fraction; learning a second rate of change in the air-fuel error with a change in the second fuel fraction; and if the first rate is within a threshold difference of the second rate, and each of the first and second rate are higher than a threshold, assigning the air-fuel error to the common error. In another example, the selective assigning of the air-fuel error from the cylinder may further include assigning a first portion of the air-fuel error to the direct fuel injector if the first rate is outside the threshold difference of the second rate while the first and the second are higher than the threshold, the first portion based on the first fuel fraction provided by the direct fuel injector; and assigning a second portion of the air-fuel error to the port fuel injector, the second portion based on the second fuel fraction provided by the port fuel injector. In yet another example, an engine may be operating with DI and PFI slopes of 1.6 and 1.3, respectively, and a common error of 0.3. By subtracting the common error of 0.3 from the individual direct and port fuel injector errors, an updated DI slope of 1.3 (1.6–0.3) and an updated PFI slope of 1.0 (1.3–0.3) may be determined. In this way, direct and port fuel injector errors may be separated from the common error to minimize overcompensating for fueling errors in a dual fuel engine while improving engine emissions.

After separating the direct and port fuel injection errors from the common error, an engine controller may be programed to store the magnitude of DI and PFI errors, and common error. The controller may also be programed to identify degraded direct and port fuel injectors. The controller may set a diagnostic code to alert a service technician about the common error.

For example, an operating engine may show an updated slope of fuel multiplier values and a fraction of directly injected fuel of 1.3 but a threshold level for a lean injector error is determined as 1.1. Also, an updated slope of fuel multiplier values and a fraction of port injected fuel may be determined as 1.2. Further, a lean common error may be determined as 0.2 but a threshold level for a lean common error may be determined as 0.15. Since, the direct and port fuel injector errors exceed the threshold level for injector error, it may be determined that one or more direct and port fuel injectors may be degraded. Furthermore, the common error is determined to be larger than the threshold level of the lean common error. Thus, presence of a common error may be confirmed. Consequently, an engine controller may be adjusted (during a subsequent engine operation) to update transfer functions of the direct and port fuel injectors to compensate for DI and PFI errors, and common error.

At T2, since one or more direct and port fuel injectors may be degraded, the transfer function of the direct injectors (642) and port fuel injectors (644) may be updated. For example, the update the transfer functions of the direct and port fuel injectors may include injecting a large fuel mass (via direct and port fuel injection) proportionate with the magnitude of the DI and PFI error. The direct and port fuel injectors with large fueling error may be shut off and engine may be operated with only direct and port fuel injectors with lower error and updated transfer functions.

In one example, fuel injected into engine may be adjusted to update an adapted fuel multiplier commanded to a direct fuel injector while disabling a port injector responsive to degradation of the port fuel injector; and an adapted fuel multiplier commanded to a port fuel injector may be updated while disabling a direct injector responsive to degradation of the direct fuel injector.

The engine speed and load may continue to increase due to an increase in driver demand torque. The fraction of directly injected fuel may increase gradually while the fraction of port injected fuel may decrease slowly. The engine air-fuel ratio may decrease to the stoichiometric level, and the adapted fuel multiplier may decrease to the initial fuel multiplier value. The slopes of the adapted fuel multiplier and fraction of fuel injected via both DI and PFI may decrease to threshold levels. Similarly, the common error may decrease to threshold levels.

Between T2 and T3, direct and port fuel injectors with low fuel injector error and updated transfer functions are operated to compensate for the fuel injector error determined prior to T2. The updating of the transfer functions of the direct fuel injectors may continue for a short duration before the updating process is stopped. The engine speed and load may remain steady for a while before decreasing. The fractions of directly injected fuel maybe maintained at high levels while fractions of port injected fuel maybe kept at low values. The engine air-fuel ratio continues to oscillate about the stoichiometric level, and the adapted fuel multiplier may continue to oscillate about the initial fuel multiplier value.

Prior to T3, the engine air-fuel ratio may decrease below the stoichiometric air-fuel ratio and the adapted fuel multiplier values may decrease below the initial fuel multiplier value. The slope of the adapted fuel multiplier values and fraction of directly injected fuel (618) may remain within threshold levels, and thus it may be determined that there is no DI error. However, the slope of the adapted fuel multiplier values and a fraction of port injected fuel (626) may exceed the threshold level for a rich injector error (632). The slope of common error may remain within threshold levels, and it may be determined that no common error is not present. It may be determined that one or more port fuel injectors may be degraded since the slope of the adapted fuel multiplier values and fraction of port injected fuel exceeds the threshold level for rich injector error. An engine controller may be programed to store the magnitude of PFI error and identity of the degraded port fuel injectors.

For example, a slope of fuel multiplier values and a fraction of directly injected fuel may be determined as 0.95 but a threshold level for a rich injector error is determined as 0.9. Since, the calculated DI slope is within the threshold level for rich injector error, it may be determined that none of the operating direct fuel injectors are degraded. Furthermore, the slope of fuel multiplier values and fraction of port injected fuel may be determined as 0.75 but a threshold level for a lean injector error is determined as 1.1. Since, the PFI slope of 0.75 is outside the threshold error levels of 0.9 and 1.1, it may be determined that one or more of the port fuel injectors may be degraded with a rich PFI error.

At T3, the transfer function of the port fuel injectors may be updated since one or more of the port injectors exhibit fueling error. Updating the transfer function of the port fuel injectors may include updating the amount of port injected fuel to compensate for the fueling error. For example, less fuel may be injected into engine cylinders to compensate for the rich PFI error determined prior to T3. Alternatively, more air may be injected into engine cylinders to compensate for the port fuel injector error. Port fuel injectors with large fueling error may be shut off and the engine may be operated with port fuel injectors with updated transfer functions and direct injectors with lower fueling error. Between T3 and T4, port fuel injectors with updated transfer functions may be operated to compensate for the PFI error. The updating of the transfer functions of the port fuel injectors may continue for a short duration before the updating process is stopped. Further, all direct fuel injectors with lower fueling error may remain operational. Subsequently, the engine speed and load may decrease gradually due to a reduction in driver demand torque. The fraction of directly injected fuel may decrease gradually while the fraction of port injected fuel may increase slowly. The engine air-fuel ratio may increase to the stoichiometric level, and the adapted fuel multiplier may increase to the initial fuel multiplier value. The slope of the adapted fuel multiplier and fraction of directly injected fuel may remain within threshold levels. The slope of the adapted fuel multiplier and fraction of port injected fuel may increase and remain within threshold levels. Further, the slope of the common error may remain within threshold levels.

Prior to T4, the engine air-fuel ratio may again decrease below the stoichiometric air-fuel ratio and the adapted fuel multiplier may also decrease below the initial fuel multiplier value. The slope of the adapted fuel multiplier values and fraction of directly injected fuel may decrease and exceed the threshold level for a rich injector error. Therefore, it may be determined that a rich DI error may be present. The engine controller may be programed to identify degraded direct fuel injectors and magnitude of DI error. The controller may be further programed to update the transfer functions of the both direct fuel injectors in a subsequent engine operation to compensate for the DI error. However, the slope of the adapted fuel multiplier values and a fraction of port injected fuel may remain within threshold levels. Likewise, the slope of the common error may remain with threshold levels. It may be determined that there is no PFI error and common error, and thus the transfer function of the port fuel injectors may not be updated.

At T4, the transfer functions of the direct fuel injectors (identified as degraded prior to T4) may be updated to compensate for DI error. Updating the transfer function of the direct fuel injectors may include updating the amount of fuel injected via direct injection to compensate for the DI error. The direct fuel injectors with large fueling error may be shut off and engine may be operated with only fuel injectors with lower error. Subsequently, the engine speed and load may decrease to low values due to a further reduction in driver demand torque. The fraction of directly injected fuel may decrease to low value while the fraction of port injected fuel may increase to a high value. The engine air-fuel ratio may increase to the stoichiometric level, and the adapted fuel multiplier may increase to the initial fuel multiplier value. The slope of the adapted fuel multiplier and fraction of fuel injected via direct fuel injectors may increase and remain within threshold levels. The slope of the adapted fuel multiplier and fraction of port injected fuel may remain within threshold levels. Further, the slope of the common error may remain within threshold levels.

Between T4 and T5, direct fuel injectors with low fueling error are operated with updated transfer functions to compensate for the DI error determined prior to T4. The updating of the transfer functions of the direct fuel injectors may continue for a short duration before the updating process is stopped. The engine speed and load are maintained at low values. The fractions of directly injected fuel may remain at low values while fractions of port injected fuel may stay at high values. The engine lambda continues to oscillate about the stoichiometric air-fuel ratio and the adapted fuel multiplier may oscillate about the initial fuel multiplier value.

In this way, by binning air-fuel error correction coefficients for individual injection systems over a range of air mass cells, as engine speed-load conditions change, common movements in the error of individual injection systems may be better correlated with common errors. As such, this enables individual injection system errors associated with a port or a direct fuel injection system to be better distinguished from common fuel or air errors, allowing for appropriate mitigating actions to be taken. In particular, transfer functions for direct and port injectors may be adjusted based on their individual errors while accounting for common errors. In doing so, inaccurate disabling of not degraded fuel injectors can be reduced. By more reliably compensating adaptive multipliers responsive to air-fuel errors, engine emissions may be improved.

In one example, a method comprises: fueling a cylinder via a first and a second fuel injector; estimating each of a first injection error of the first injector, a second injection error of the second injector, and a common error as a function of an air-fuel ratio error and a fraction of fuel injected via each of the first and second injector; and correcting each of the first and second error based on the common error. In the preceding example, additionally or optionally, the common error is a fuel system error common to each of the first and second injector, the common error including one or more of an airflow error associated with an airflow path delivering air to both the first fuel injector and the second fuel injector, and a fuel-type error associated with the fuel injected by both the first fuel injector and the second fuel injector.

In any or all of the preceding examples, additionally or optionally, estimating as a function of the air-fuel ratio error and the fraction includes: dividing a rate of change of air-fuel ratio error by the fraction of fuel injected via the first fuel injector to determine a first slope; dividing the rate of change of air-fuel ratio error by the fraction of fuel injected via the second fuel injector to determine a second slope; and if the first slope is within a threshold difference of the second slope, and each of the first and second slope is higher than a threshold value, learning a minimum of the first and second slope as the common error. In any or all of the preceding examples, additionally or optionally, correcting each of the first and second error based on the common error includes: determining a correction factor based on the common error; and reducing each of the first and the second error by applying the correction factor. Any or all of the preceding examples, may additionally or optionally further comprise, adjusting a transfer function of the first fuel injector with the reduced first error; adjusting a transfer function of the second fuel injector with the reduced second error; and adjusting fueling of the cylinder using the adjusted transfer function of the first and the second fuel injector.

In any or all of the preceding examples, additionally or optionally, the estimating further includes: if the first slope is not within the threshold difference of the second slope, learning the air-fuel ratio error as the error associated with the first fuel injector when the first slope is higher than the threshold value; and learning the air-fuel ratio error as the error associated with the second fuel injector when the second slope is higher than the threshold value. Furthermore, any or all of the preceding examples, may additionally or optionally further comprise, comparing the reduced first error with the reduced second error; deactivating the first injector when the first error is larger and fueling the engine with the second fuel injector; and deactivating the second injector when the second error is larger and fueling the engine with the first fuel injector. In any or all of the preceding examples, additionally or optionally, the injecting is performed in each of a plurality of engine air mass flow regions and wherein each of the first, second, and common error are learned in each of the plurality of engine air mass flow regions as a function of air mass flow. In any or all of the preceding examples, additionally or optionally, the first fuel injector is a direct fuel injector and where the second fuel injector is a port fuel injector.

In another example, a method for an engine fuel system, may comprise: injecting fuel to an engine cylinder via a first fuel injector and a second fuel injector during a cylinder cycle, the first and second fuel injector having distinct types of fuel injection; assigning a first portion of an air-fuel error from the cylinder during the cylinder cycle to a first error associated with the first fuel injector; assigning a second portion of the air-fuel error to a second error associated with the second fuel injector; and assigning a third portion of the air-fuel error to a common error associated with the fuel system, wherein each of the first, second, and third portion is based on each of a first fuel fraction provided by the first fuel injector, a second fuel fraction provided by the second fuel injector, and the air-fuel error. The preceding example may additionally or optionally comprise, the assigning includes: learning a first rate of change in the air-fuel error with a change in the first fuel fraction; learning a second rate of change in the air-fuel error with a change in the second fuel fraction; and if the first rate is within a threshold difference of the second rate, and each of the first and second rate are higher than a threshold, assigning a minimum of the first rate and the second rate to the common error. In any or all of the preceding examples, additionally or optionally, the assigning further includes: if the first rate is outside the threshold difference of the second rate while the first and the second are higher than the threshold, assigning the first portion based on the first fuel fraction provided by the first fuel injector; and assigning the second portion based on the second fuel fraction provided by the second fuel injector.

Furthermore, any or all of the preceding examples, may additionally or optionally further comprise, assigning a first adaptive fuel multiplier corresponding to the first error to the first fuel injector; assigning a second adaptive fuel multiplier corresponding to the second error to the second fuel injector; updating each of the first and second adaptive fuel multiplier with a correction factor based on the common error; and adjusting fueling of the engine with each of the updated first and second adaptive fuel multipliers. Any or all of the preceding examples, may additionally or optionally further comprise, limiting operation of the first fuel injector in response to the first portion of the air-fuel error being greater than the second portion; and limiting operation of the second fuel injector in response to the second portion of the air-fuel error being greater than the first portion. In any or all of the preceding examples, additionally or optionally, limiting operation of the first fuel injector includes fueling the engine via only the second injector and wherein limiting operation of the second fuel injector includes fueling the engine via only the first injector.

In any or all of the preceding examples, additionally or optionally, each of the first, second, and third portion are learned as a function of air mass flow. Another example engine system comprises: an engine including a cylinder; a port fuel injector in fluidic communication with the cylinder; a direct fuel injector in fluidic communication with the cylinder; an exhaust air-fuel ratio sensor; and a controller including executable instructions stored in non-transitory memory for: while operating the engine with closed loop air-fuel ratio control based on feedback from the air-fuel ratio sensor, updating an adaptive fuel multiplier for each of the port and the direct injector with a correction factor based on a common error in airflow to both the port and the direct injector, the common error estimated based on a ratio of a change in air-fuel error to a change in fuel fraction from the port and the direct injector during engine fueling; and adjusting fueling via one or more of the port and direct fuel injection using the adaptive fuel multipliers. In any or all of the preceding examples, additionally or optionally, the adaptive fuel multiplier for the port injector is based on a first ratio of the change in air-fuel error to the change in fuel fraction from the port injector, wherein the adaptive fuel multiplier for the direct injector is based on a second ratio of the change in air-fuel error to the change in fuel fraction from the direct injector, wherein the common error is based on a minimum of the first and the second ratio when the first and the second ratio are within a threshold of each other, and wherein the updating includes reducing the adaptive fuel multiplier for each of the port and the direct injector.

Furthermore, any or all of the preceding examples, may additionally or optionally further comprise, indicating degradation of the port fuel injector when the adjusted adaptive fuel multiplier for the port injector is higher than a threshold; indicating degradation of the direct fuel injector when the adjusted adaptive fuel multiplier for the fuel injector is higher than the threshold; and indicating engine fueling error due to the common error when the adjusted adaptive fuel multiplier for each of the port and the direct injector have a common directionality and each adjusted adaptive fuel multiplier is higher than the threshold. In any or all of the preceding examples, additionally or optionally, the air-fuel error is based on a difference between a commanded air-fuel ratio and an actual air-fuel ratio estimated by the air-fuel ratio sensor, and wherein the adjusting the fueling includes: updating the adapted fuel multiplier commanded to the direct fuel injector while disabling the port injector responsive to degradation of the port fuel injector; and updating the adapted fuel multiplier commanded to the port fuel injector while disabling the direct injector responsive to degradation of the direct fuel injector.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for fueling a cylinder of an engine with injectors, comprising: injecting fuel to the cylinder via a first fuel injector and a second fuel injector; and obtaining and distinguishing an error associated with the first fuel injector or the second fuel injector from a common fuel system error, common to both the first and second injectors, as a function of a time rate of change of air-fuel ratio error based on exhaust sensor feedback and a fraction of fuel injected via the first fuel injector or the second fuel injector, and correcting each of the first and second errors based on the common fuel system error by determining a correction based on the common fuel system error; and reducing each of the first error and the second error by applying the correction.

2. The method of claim 1, wherein the common fuel system error includes one or more of an airflow error associated with an airflow path delivering air to both the first fuel injector and the second fuel injector, and a fuel-type error associated with the fuel injected by both the first fuel injector and the second fuel injector.

3. The method of claim 1, where estimating as a function of the air-fuel ratio error and the fraction includes: dividing the time rate of change of air-fuel ratio error by the fraction of fuel injected via the first fuel injector to determine a first slope; dividing the time rate of change of air-fuel ratio error by the fraction of fuel injected via the second fuel injector to determine a second slope; and if the first slope is within a threshold difference of the second slope, and each of the first slope and the second slope is higher than a threshold value, learning a minimum of the first slope and the second slope as the common fuel system error.

4. The method of claim 1, further comprising: adjusting a transfer function of the first fuel injector with the reduced first error; adjusting a transfer function of the second fuel injector with the reduced second error; and adjusting fueling of the cylinder using the adjusted transfer functions of the first and second fuel injectors.

5. The method of claim 3, wherein the estimating further includes: if the first slope is not within the threshold difference of the second slope, learning the air-fuel ratio error as the error associated with the first fuel injector when the first slope is higher than the threshold value; and learning the air-fuel ratio error as the error associated with the second fuel injector when the second slope is higher than the threshold value.

6. The method of claim 1, further comprising comparing the reduced first error with the reduced second error; deactivating the first injector when the first error is larger and fueling the engine with the second fuel injector; and deactivating the second injector when the second error is larger and fueling the engine with the first fuel injector.

7. The method of claim 1, wherein the injecting is performed in each of a plurality of engine air mass flow regions and wherein each of the first, second, and common errors is learned in each of the plurality of engine air mass flow regions as a function of air mass flow.

8. The method of claim 1, where the first fuel injector is a direct fuel injector and where the second fuel injector is a port fuel injector.

9. A method for an engine fuel system with injectors, comprising: injecting fuel to an engine cylinder via a first fuel injector and a second fuel injector during a cylinder cycle, the first and second fuel injectors having distinct types of fuel injection; obtaining and assigning a first portion of an air-fuel error from the cylinder during the cylinder cycle to a first error associated with the first fuel injector;

obtaining and assigning a second portion of the air-fuel error to a second error associated with the second fuel injector; and obtaining and assigning a third portion of the air-fuel error to a common error associated with the fuel system, wherein each of the first, second, and third portions is based on each of a first fuel fraction provided by the first fuel injector, a second fuel fraction provided by the second fuel injector, and the air-fuel error, the air-fuel error based on exhaust gas sensor feedback, wherein the assigning includes: learning a first time rate of change in the air-fuel error with a change in the first fuel fraction; learning a second time rate of change in the air-fuel error with a change in the second fuel fraction; and if the first time rate is within a threshold difference of the second time rate, and each of the first and second time rates is higher than a threshold, assigning a minimum of the first time rate and the second time rate to the common error.

10. The method of claim 9, wherein the assigning further includes: if the first time rate is outside the threshold difference of the second time rate while the first and second time rates are higher than the threshold, assigning the first portion based on the first fuel fraction provided by the first fuel injector; and assigning the second portion based on the second fuel fraction provided by the second fuel injector.

11. The method of claim 9, further comprising: assigning a first adaptive fuel multiplier corresponding to the first error to the first fuel injector;

assigning a second adaptive fuel multiplier corresponding to the second error to the second fuel injector; updating each of the first and second adaptive fuel multipliers with a correction factor based on the common error; and adjusting fueling of the engine with each of the updated first and second adaptive fuel multipliers.

12. The method of claim 9, further comprising: limiting operation of the first fuel injector in response to the first portion of the air-fuel error being greater than the second portion; and limiting operation of the second fuel injector in response to the second portion of the air-fuel error being greater than the first portion.

13. The method of claim 12, wherein limiting operation of the first fuel injector includes fueling the engine via only the second fuel injector and wherein limiting operation of the second fuel injector includes fueling the engine via only the first fuel injector.

14. The method of claim 9, wherein each of the first, second, and third portions is learned as a function of air mass flow.

15. An engine system, comprising: an engine including a cylinder; a port fuel injector in fluidic communication with the cylinder; a direct fuel injector in fluidic communication with the cylinder; an exhaust air-fuel ratio sensor; and a controller including executable instructions stored in non-transitory memory for: while operating the engine with closed loop air-fuel ratio control based on feedback from the air-fuel ratio sensor, updating an adaptive fuel multiplier for each of the port fuel injector and the direct fuel injector with a correction factor based on a common error in airflow to both the port fuel injector and the direct fuel injector, the common error estimated based on a ratio of a change in air-fuel error to a change in fuel fraction from the port fuel injector and the direct fuel injector during engine fueling; and adjusting fueling via one or more of the port and direct fuel injectors using the adaptive fuel multipliers, the air-fuel error based on an exhaust gas sensor, wherein the adaptive fuel multiplier for the port fuel injector is based on a first ratio of the change in air-fuel error to the change in fuel fraction from the port fuel injector, wherein the adaptive fuel multiplier for the direct fuel injector is based on a second ratio of the change in air-fuel error to the change in fuel fraction from the direct fuel injector, wherein the common error is based on a minimum of the first ratio and the second ratio when the first ratio and the second ratio are within a threshold of each other, and wherein the updating includes reducing the adaptive fuel multiplier for each of the port fuel injector and the direct fuel injector.

16. The system of claim 15, further comprising: indicating degradation of the port fuel injector when the adjusted adaptive fuel multiplier for the port fuel injector is higher than a threshold; indicating degradation of the direct fuel injector when the adjusted adaptive fuel multiplier for the direct fuel injector is higher than the threshold; and indicating engine fueling error due to the common error when the adjusted adaptive fuel multiplier for each of the port fuel injector and the direct fuel injector has a common directionality and each adjusted adaptive fuel multiplier is higher than the threshold.

17. The system of claim 16, wherein the air-fuel error is based on a difference between a commanded air-fuel ratio and an actual air-fuel ratio estimated by the air-fuel ratio sensor, and wherein the adjusting the fueling includes: updating the adaptive fuel multiplier commanded to the direct fuel injector while disabling the port fuel injector responsive to degradation of the port fuel injector; and updating the adaptive fuel multiplier commanded to the port fuel injector while disabling the direct fuel injector responsive to degradation of the direct fuel injector.

* * * * *